US008957930B2

(12) United States Patent
Aihara

(10) Patent No.: US 8,957,930 B2
(45) Date of Patent: Feb. 17, 2015

(54) PRINTING APPARATUS

(71) Applicant: Yuichi Aihara, Yamanashi-ken (JP)

(72) Inventor: Yuichi Aihara, Yamanashi-ken (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/222,068

(22) Filed: Mar. 21, 2014

(65) Prior Publication Data

US 2014/0292991 A1 Oct. 2, 2014

(51) Int. Cl.

| | |
|---|---|
| ***B41J 35/36*** | (2006.01) |
| ***B41J 17/36*** | (2006.01) |
| ***B41J 2/325*** | (2006.01) |

(52) U.S. Cl.

CPC . *B41J 2/325* (2013.01); *B41J 17/36* (2013.01); *B41J 35/36* (2013.01)

USPC ..... 347/217

(58) Field of Classification Search

USPC ..... 347/217; 400/247, 249

See application file for complete search history.

(56) References Cited

U.S. PATENT DOCUMENTS 5,333,960 A * 8/1994 Nam ..... 400/249

FOREIGN PATENT DOCUMENTS

| | | | |
|---|---|---|---|
| JP | 57-166258 | * 10/1982 | ..... B41J 29/48 |
| JP | 8-197817 | * 8/1996 | ..... B41J 35/16 |
| JP | 2009-113251 A | 5/2009 | |

* cited by examiner

*Primary Examiner* — Huan Tran

(74) *Attorney, Agent, or Firm* — Manabu Kanesaka

(57) ABSTRACT

To provide a printing apparatus with high printing quality that reduces a transport amount of an ink ribbon except printing operation and that suppresses skew of the ink ribbon, diameters of spools 43, 44 are calculated from rotation amounts of the supply spool 43 and wind-up spool 44 corresponding to a printing length in a sub-scanning direction of the printing data during driving of a thermal head 40, a value of the calculated diameter is compared with a value of a beforehand set diameter, it is thereby determined whether or not an ink ribbon 41 is near empty, and when the ink ribbon is not near empty, the ribbon 41 is wound around the spool 44 up to a printing end position in which a rear end of a used portion of the ribbon 41 passes through a peeling member 28, while when the ink ribbon is near empty, the ribbon 41 is wound around the spool 44 until an empty mark EMP_M arrives at a position detectable by a sensor Se2, and then is rewound around the spool 43 until a front end of an unused portion of the ribbon 41 arrives at a feeding position.

6 Claims, 16 Drawing Sheets

PRINTING APPARATUS

TECHNICAL FIELD

The present invention relates to a printing apparatus, and more particularly, to a printing apparatus that performs printing processing on a recording medium with a thermal head via an ink ribbon.

BACKGROUND ART

Conventionally, such a printing apparatus has been known widely that forms an image such as a photograph of face and character information on a printing medium such as a plastic card. In such a printing apparatus, an indirect printing scheme is used in which an image (mirror image) is formed on a transfer film (recording medium) with a thermal head via an ink ribbon, and next the image formed on the transfer film is referred to a printing medium.

This type of printing apparatus has conventionally detected a remaining amount of the ink ribbon by detecting the diameter of the supply spool or wind-up spool. For example, Patent Document 1 discloses techniques for detecting passage of a Bk (Black) panel (surface) with a sensor, and detecting a remaining amount of the ink ribbon from how many times the spool rotates during the period. In other words, when it is assumed that the length of the Bk panel is 98 mm, it is detected how many times the spool rotates for a period during which the Bk panel is transported 98 mm. Since the rotation amount is smaller as the diameter is thicker, while being larger as the diameter thinner, the diameter of the spool is calculated from the rotation amount.

PRIOR ART DOCUMENT

Patent Document

[Patent Document 1] Japanese Patent Application Publication No. 2009-113251 (see FIG. 15)

DISCLOSURE OF INVENTION

Problems to be Solved by the Invention

In addition, in the case of calculating the spool diameter by passage of the Bk panel, two following methods are conceivable. (1) The passage of the Bk panel is detected during printing operation. (2) The passage of the Bk panel is detected by once winding the ink ribbon at the initial time or after finishing printing, irrespective of the printing operation.

In the method of above-mentioned (1), when printing is finished during detection of the Bk panel, the rotation of the spool is once halted at some midpoint, and then, the spool rotates again. At this point, since the rotation amount of the spool is not stabilized due to the effect of backlash and the like, detection accuracy degrades. Meanwhile, in the method of above-mentioned (2), since it is necessary to separately perform the operation of winding the ink ribbon independently of the printing operation, problems of skew of the ink ribbon and the like occur, and become a cause of color deviation.

Further, to detect a use limit (empty) of the ink ribbon, it is necessary to detect an empty mark attached to the end portion of the ink ribbon with a sensor, and to detect, it is necessary to wind the ink ribbon. Particularly, when the length of the ink ribbon laid between the supply spool and the wind-up spool is set to be short in order to miniaturize the printing apparatus, the empty mark attached to an unused portion of the ink ribbon is in a state of being wound around the supply spool, and therefore, unless the ribbon is wound to the wind-up spool side, it is not possible to detect the empty mark with the sensor during the printing operation.

In view of the above-mentioned matter, it is an object of the present invention to provide a printing apparatus with high printing quality that reduces a transport amount of an ink ribbon except printing operation and that suppresses skew of the ink ribbon.

Means for Solving the Problem

To attain the above-mentioned object, the present invention is characterized in that a printing apparatus for performing printing processing on a recording medium with a thermal head via an ink ribbon is provided with a thermal head that heats a plurality of heater elements lined up in a main scanning direction selectively according to printing data, an ink ribbon laid between a supply spool and a wind-up spool, transport means for transporting the ink ribbon to be wound around the wind-up spool or to be rewound around the supply spool, a sensor provided between the supply spool and the thermal head to detect an empty mark attached to an end portion of the ink ribbon to indicate a use limit of the ink ribbon, a peeling member provided between the thermal head and the wind-up spool to peel off the ink ribbon and the recording medium, rotation amount detecting means for detecting a rotation amount of at least one spool of the supply spool and the wind-up spool, and control means for controlling driving of the thermal head and transport of the ink ribbon by the transport means, and that the control means calculates a diameter of the at least one spool from the rotation amount of the at least one spool detected in the rotation amount detecting means corresponding to a printing length in a sub-scanning direction of the printing data during driving of the thermal head, compares a value of the calculated diameter with a value of a beforehand set diameter, thereby determines whether or not the ink ribbon is near empty indicative of running short, and when determining that the ink ribbon is not near empty, controls the transport means to wind the ink ribbon around the wind-up spool up to a printing end position in which a rear end of a used portion of the ink ribbon passes through the peeling member, while when determining that the ink ribbon is near empty, controlling the transport means to wind the ink ribbon around the wind-up spool until the empty mark arrives at a position detectable by the sensor, and then controlling the transport means to rewind the ink ribbon around the supply spool until a front end of an unused portion of the ink ribbon arrives at the printing end position or at a predetermined position beyond the printing end position.

In the invention, the control means detects a rotation amount of the spool corresponding to a printing length in the sub-scanning direction of printing data during driving of the thermal head, instead of detecting a rotation amount of the spool during the passage of the Bk (Black) panel as in conventional techniques. Next, the means calculates the diameter of the spool from the detected rotation amount, compares a value of the calculated diameter with a value of the beforehand set diameter, and thereby determines whether or not the ink ribbon is near empty. The spool can be at least one spool of the supply spool and the wind-up spool. In the case of determining that the ink ribbon is not near empty, since a usable ink ribbon (unused portion) is sufficiently left and it is not necessary to detect the empty mark, the control means controls the transport means to wind the ink ribbon around the wind-up spool up to a printing end position in which the rear end of a used portion of the ink ribbon passes through the peeling member. Accordingly, it is not necessary to wind an excessive ink ribbon around the wind-up spool to detect the empty mark, it is possible to suppress the transport amount of the ink ribbon during the printing operation, it is thereby possible to prevent skew of the ink ribbon not to cause color deviation, and as a result it is possible to enhance the printing quality. Then, only in the case of determining that the ink ribbon is near empty, in order to detect the empty mark, the control means controls the transport means to wind the ink ribbon around the wind-up spool until the empty mark arrives at a position detectable by the sensor, and then controls the transport means to rewind the ink ribbon around the supply spool until the front end of an unused portion of the ink ribbon arrives at the printing end position or at a predetermined position beyond the printing end position.

In the invention, in the case of determining that the ink ribbon is near empty, the control means may control the transport means to wind the ink ribbon around the wind-up spool until the empty mark arrives at a position detectable by the sensor, determine whether or not the sensor detects the empty mark, and when determining that the empty mark is not detected, control the transport means to rewind the ink ribbon around the supply spool until a front end of an unused portion of the ink ribbon reaches a beforehand set feeding position positioned on the side closer to the supply spool than the thermal head, while when determining that the empty mark is detected, controlling the transport means to halt transport of the ink ribbon.

Further, notifying means for notifying that replacement of the ink ribbon is needed is further provided, and in the case of determining that the ink ribbon is near empty, when determining that the empty mark is detected, the control means may notify the notifying means that replacement of the ink ribbon is needed.

Furthermore, a plurality of color ribbon panels is disposed between a ribbon panel of Bk (Black) and a next ribbon panel of Bk (Black), the ink ribbon is configured by repeating the color ribbon panels and the ribbon panel of Bk (Black) in a face sequential manner, and it is preferable that the empty mark is attached to a ribbon panel of a second color among the color ribbon panels.

Still furthermore, the color ribbon panels include at least three colors of Y (Yellow), M (Magenta) and C (Cyan), and the apparatus may be miniaturized by setting the length of the ink ribbon laid between the supply spool and the wind-up spool to be shorter than a total length of three ribbon panels among ribbon panels of successive four colors of Y (Yellow), M (Magenta), C (Cyan) and Bk (Black).

Moreover, in order to miniaturize the apparatus, along the ink ribbon laid between the supply spool and the wind-up spool, it is preferable to set each of a distance between the supply spool and the sensor, a distance between the sensor and the thermal head, a distance between the thermal head and the peeling member, and a distance between the peeling member and the wind-up spool to be shorter than a length of a ribbon panel of one color of the ink ribbon.

Advantageous Effect of the Invention

According to the present invention, the control means calculates the diameter of the spool from a rotation amount of the spool corresponding to a printing length in the sub-scanning direction of printing data during driving of the thermal head, and compares the value of the calculated diameter with the value of the beforehand set diameter to determine whether or not the ink ribbon is near empty. Then, only in the case of determining that the ink ribbon is near empty, in order to detect the empty mark, the control means controls the transport means to wind the ink ribbon around the wind-up spool until the empty mark arrives at a position detectable by the sensor, and then controls the transport means to rewind the ink ribbon around the supply spool until the front end of an unused portion of the ink ribbon arrives at the printing end position or at a predetermined position beyond the printing end position. In the case of determining that the ink ribbon is not near empty, since a usable ink ribbon is sufficiently left and it is not necessary to detect the empty mark, the control means controls the transport means to wind the ink ribbon around the wind-up spool up to the printing end position in which the rear end of a used portion of the ink ribbon passes through the peeling member, it is thus not necessary to wind an excessive ink ribbon around the wind-up spool to detect the empty mark, and it is possible to suppress the transport amount of the ink ribbon during printing operation. Therefore, it is possible to obtain the effects of preventing skew of the ink ribbon not to cause color deviation, and as a result, of enhancing the printing quality.

BRIEF DESCRIPTION OF DRAWINGS

FIG. 16A illustrates the time of normal processing before detecting near empty, and FIG. 16B illustrates the time of near empty processing after detecting near empty.

MODE FOR CARRYING OUT THE INVENTION

With reference to drawings, described below is an Embodiment in which the present invention is applied to a printing apparatus for printing and recording text and image on a card, while performing magnetic or electric information recording on the card.

<System Configuration>

Figure 1:
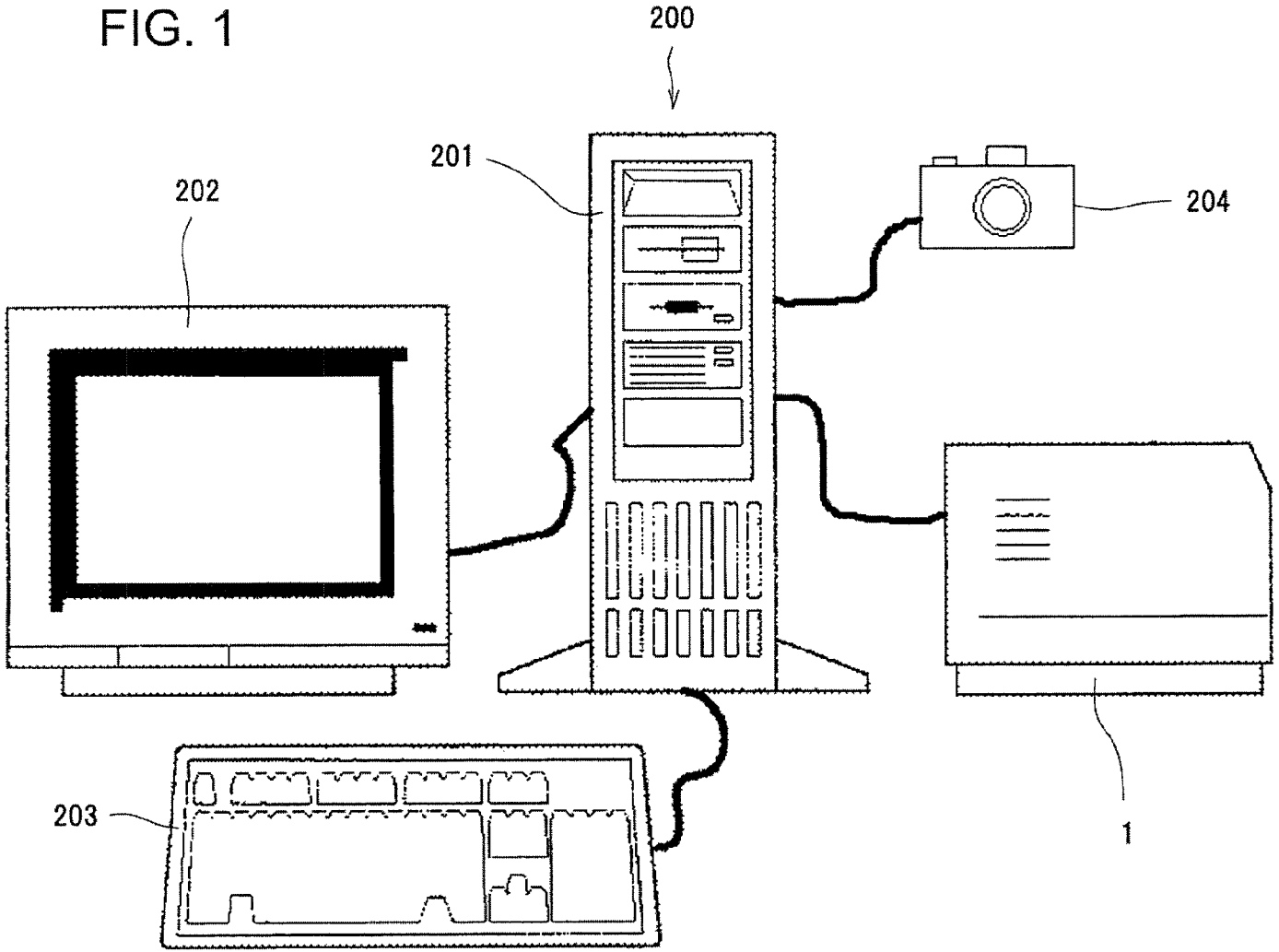
FIG. 1 is an outside view of a printing system including a printing apparatus of an Embodiment to which the present invention is applicable.
Figure 14:
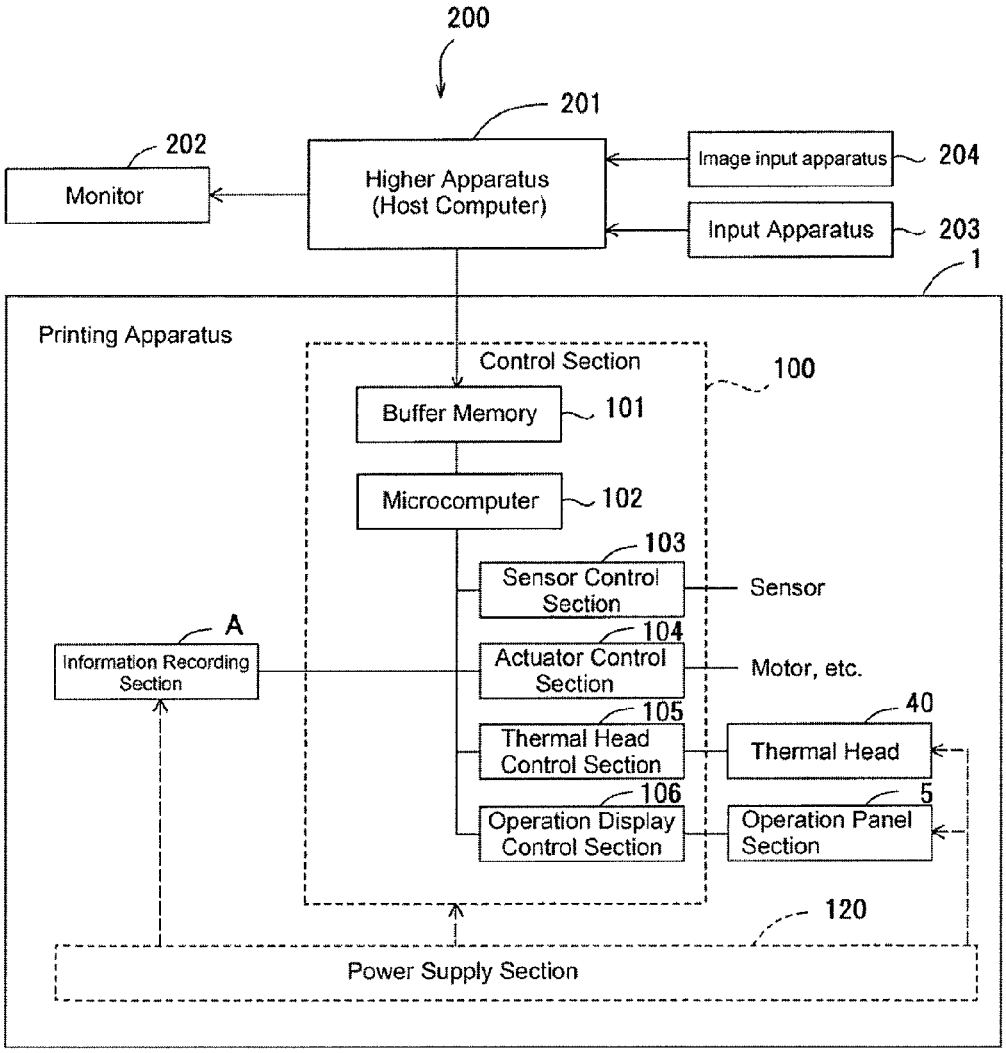
FIG. 14 is a block diagram illustrating a schematic configuration of a control section in the printing apparatus of the Embodiment.

As shown in FIGS. 1 and 14, a printing apparatus 1 of this Embodiment constitutes a part of a printing system 200. In other words, the printing system 200 is broadly comprised of a higher apparatus 201 (for example, host computer such as a personal computer) and the printing apparatus 1.

The printing apparatus 1 is connected to the higher apparatus 201 via an interface with the figure omitted, and the higher apparatus 201 is capable of transmitting printing data, magnetic or electric recording data and the like to the printing apparatus 1 to indicate recording operation and the like. In addition, the printing apparatus 1 has an operation panel section (operation display section) 5 (see FIG. 14), and as well as recording operation indication from the higher apparatus 201, recording operation is also capable of being indicated from the operation panel section 5.

The higher apparatus 201 is generally connected to an image input apparatus 204 such as a digital camera and scanner, an input apparatus 203 such as a keyboard and mouse to input commands and data to the higher apparatus 201, and a monitor 202 such as a liquid crystal display to display data and the like generated in the higher apparatus 201.

<Printing Apparatus>

Figure 2:
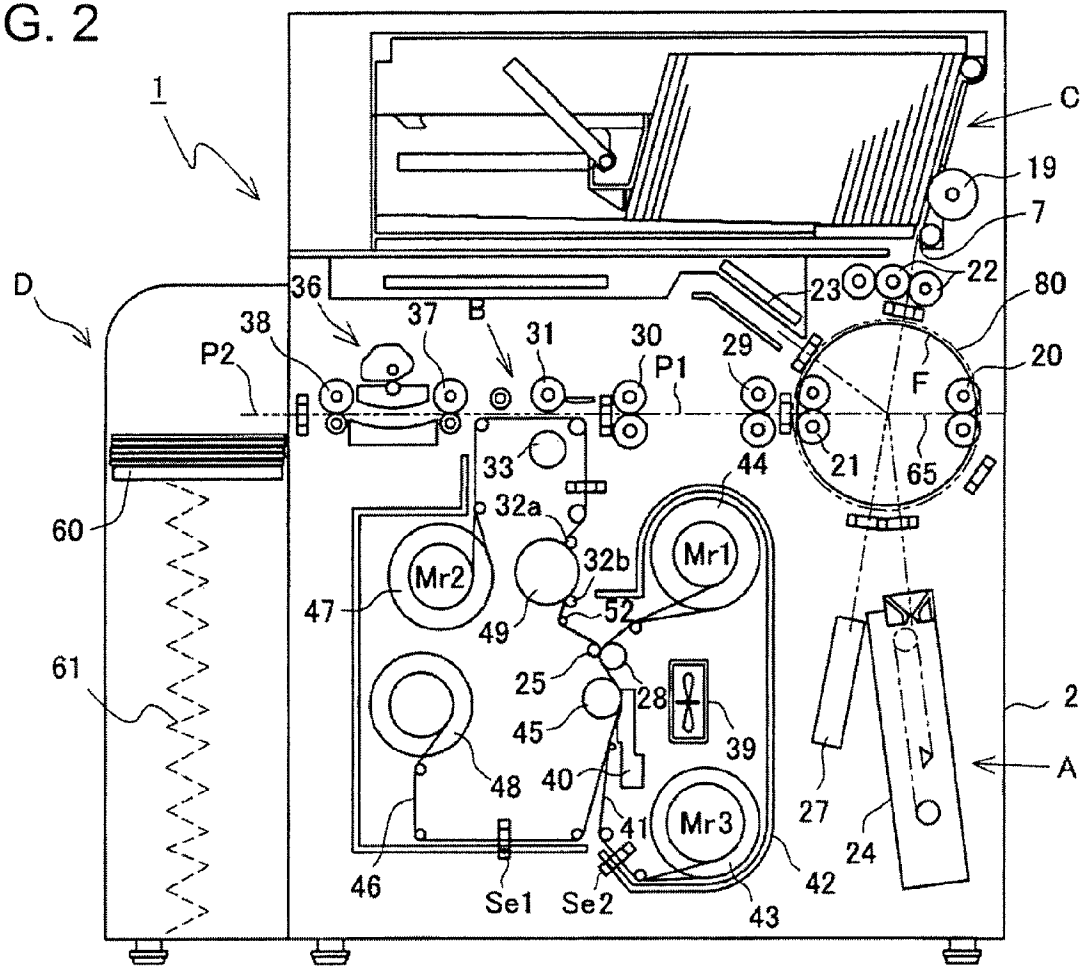
FIG. 2 is a schematic configuration view of the printing apparatus of the Embodiment.

As shown in FIG. 2, the printing apparatus 1 has a housing 2, and the housing 2 is provided with an information recording section A, image formation section B, media storage section C and storage section D.

The information recording section A is comprised of a magnetic recording section 24, non-contact type IC recording section 23, and contact type IC recording section 27.

The media storage section C aligns and stores a plurality of cards in a standing posture, is provided at its front end with a separation opening 7, and feeds and supplies starting with the card in the front row with a pickup roller 19.

The fed card is first sent to a reverse unit F with carry-in rollers 22. The reverse unit F is comprised of a rotating frame 80 bearing-supported by the housing 2 to be turnable, and two roller pairs 20, 21 supported on the frame. Then, the roller pairs 20, 21 are axially supported by the rotating frame 80 to be rotatable.

Around the reverse unit F in the turn direction are disposed the magnetic recording section 24, non-contact type IC recording section 23, and contact type IC recording section 27. Then, the roller pairs 20, 21 form a medium carry-in path 65 for carrying in toward one of the information recording sections 23, 24 and 27, and data is magnetically or electrically written on the card in the recording sections.

The image formation section B is to form an image such as a photograph of face and character data on frontside and backside of the card, and a medium transport path P1 for carrying the card is provided on an extension of the medium carry-in path 65. Further, in the medium transport path P1 are disposed transport rollers 29, 30 that transport the card, and the rollers are coupled to a transport motor not shown.

The image formation section B is provided with a film-shaped medium transport apparatus, a first transfer section that first prints an image, with a thermal head 40, on a transfer film 46 transported with the transport apparatus, and a second transfer section that subsequently prints the image printed on the transfer film 46 on the frontside of the card existing in the medium transport path P1 with a heat roller 33.

On the downstream side of the image formation section B is provided a medium transport path P2 for carrying the printed card to a storage stacker 60. In the medium transport path P2 are disposed transport rollers 37, 38 that transport the card, and the rollers are coupled to a transport motor not shown.

A decurl mechanism 36 is disposed in between the transport roller 37 and the transport roller 38, presses the card center portion held between the transport rollers 37, 38, and thereby corrects curl generated by thermal transfer with the heat roller 33. Therefore, the decurl mechanism 36 is configured to be able to shift to positions in the vertical direction as viewed in FIG. 2 by an up-and-down mechanism such as a cam not shown.

The storage section D is configured to store cards sent from the image formation section Bin the storage stacker 60. The storage stacker 60 is configured to shift downward in FIG. 2 with an up-and-down mechanism 61.

The image formation section B in the entire configuration of the above-mentioned printing apparatus 1 will be further described specifically.

The transfer film 46 is wound around each of a wind-up roll 47 and feed roll 48 of a transfer film cassette rotated by driving a motor Mr2. A film transport roller 49 is a main driving roller for carrying the transfer film 46, and a transport amount and transport halt position of the transfer film 46 is determined by controlling driving of the roller 49. The motor Mr2 is also driven at the time of driving the film transport roller 49, is for the wind-up roll 47 to reel the fed transfer film 46, and is not driven as main transport of the transfer film 46.

Pinch rollers 32*a* and 32*b* are disposed on the periphery of the film transport roller 49. Although not shown in FIG. 2, the pinch rollers 32*a* and 32*b* are configured to be movable to move and retract with respect to the film transport roller 49, and in a state in the figure, the rollers move to the film transport roller 49 to come into press-contact, and thereby wind the transfer film 46 around the film transport roller 49. By this means, the transfer film 46 undergoes accurate transport by a distance corresponding to the number of revolutions of the film transport roller 49.

An ink ribbon 41 is stored in an ink ribbon cassette 42, a supply spool 43 for supplying the ink ribbon and wind-up spool 44 for winding the ink ribbon 41 are stored in the cassette 42, the wind-up spool 44 is driven with a motor Mr1, and the supply spool 43 is driven with a motor Mr3. Forward-backward rotatable DC motors are used for the motors Mr1 and Mr3. Further, "Se2" shown in FIG. 2 denotes a transmission sensor to detect an empty mark (see reference mark EMP_M in FIG. 16B) indicative of a use limit of the ink ribbon 41 attached to the end portion of the ink ribbon 41. In addition, the ink ribbon 41 is formed by repeating ribbon panels of Y (Yellow), M (Magenta), C (Cyan) and Bk (Black) that are color ribbon panels in a face sequential manner. Further, the sensor Se2 also detects the passage of the Bk panel, and position management inside each ribbon panel is performed by detection of the Bk panel, and is used for ribbon feeding and the like described later. More specifically, position management inside Y (Yellow), M (Magenta) and C (Cyan) between Bk (Black) and next Bk (Black) is performed by detecting a rotation amount of the supply spool 43 from an Off edge of Bk (Black) (detecting a rotation amount of the supply spool 43 with an encoder 121 described later). In this Embodiment, since there are no marks indicating boundaries between Y (Yellow) and M (Magenta) and between M (Magenta) and C (Cyan), the Off edge (Bk rear end) of Bk is judged as being a start position (front end of Y) of Y (Yellow), and by relative position management from this point, the boundary (front end of M) between Y (Yellow) and M (Magenta) and the boundary (front end of C) between M (Magenta) and C (Cyan) are judged.

A platen roller 45 and thermal head 40 form the first transfer section, and the thermal head 40 is disposed in a position opposed to the platen roller 45. The thermal head 40 is heated and controlled by a head control IC (not shown) according to image data, and an image is printed on the transfer film 46 using the sublimation ink ribbon 41. In addition, a cooling fan 39 is to cool the thermal head 40.

The ink ribbon 41 with which printing on the transfer film 46 is finished is peeled off from the transfer film 46 with a peeling roller 25 and peeling member 28. The peeling member 28 is fixed to the cassette 42, the peeling roller 25 comes into contact with the peeling member 28 in printing, and the roller 25 and member 28 nip the transfer film 46 and ink ribbon 41 to peel. Then, the peeled ink ribbon 41 is wound around the wind-up spool 44 by driving the motor Mr1, and the transfer film 46 is transported to the second transfer section including a platen roller 31 and heat roller 33 by the film transport roller 49.

In the second transfer section, the transfer film 46 is nipped together with the card by the heat roller 33 and platen roller 31, and the image on the transfer film 46 is transferred to the card surface. In addition, the heat roller 33 is attached to an up-and-down mechanism (not shown) so as to come into contact with and separate from the platen roller 31 via the transfer film 46.

Figure 3:
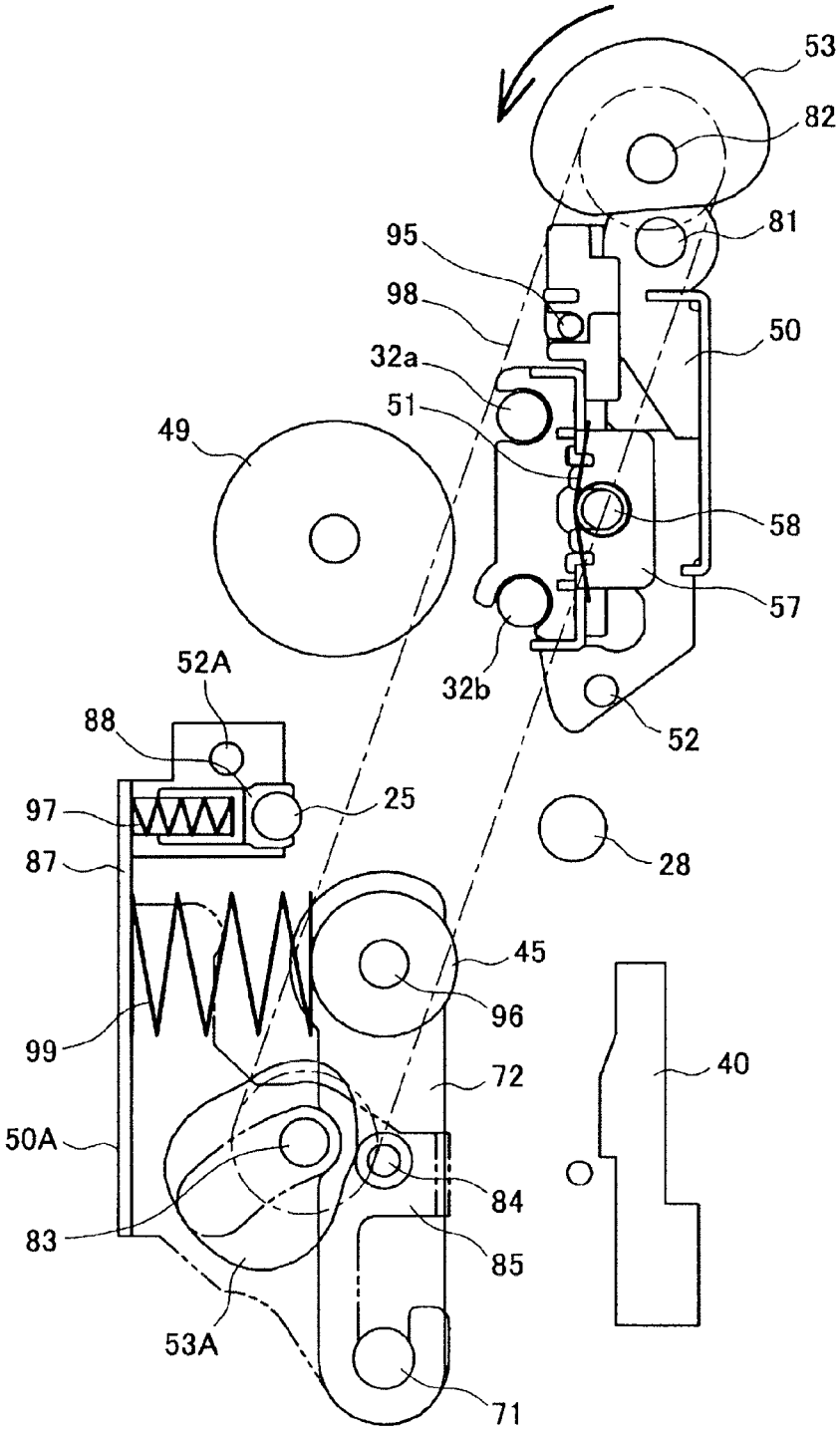
FIG. 3 is an explanatory view of a control state by a cam in a waiting position in which pinch rollers and film transport roller are separated from each other, and a platen roller and thermal head are separated from each other.
Figure 4:
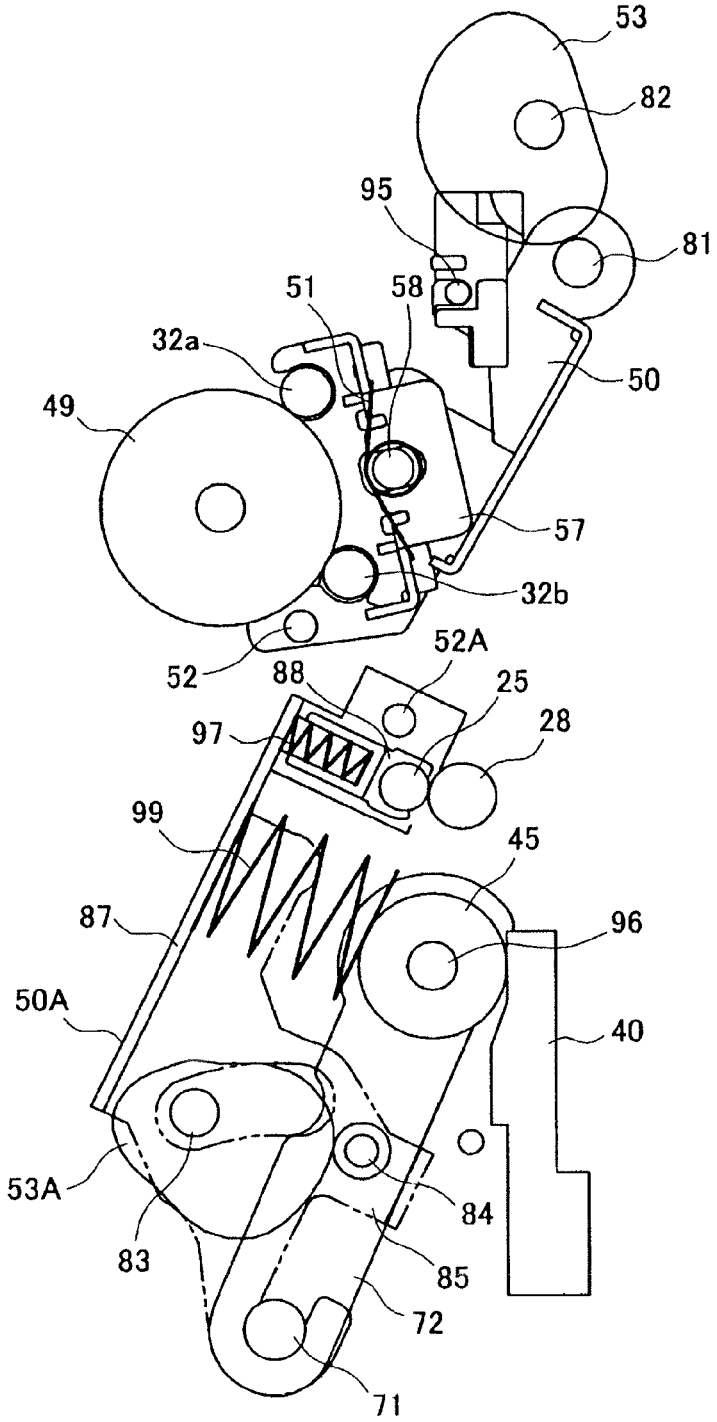
FIG. 4 is an explanatory view of a control state by the cam in a printing position in which the pinch rollers and film transport roller are brought into contact with each other, and the platen roller and thermal head are brought into contact with each other.
Figure 5:
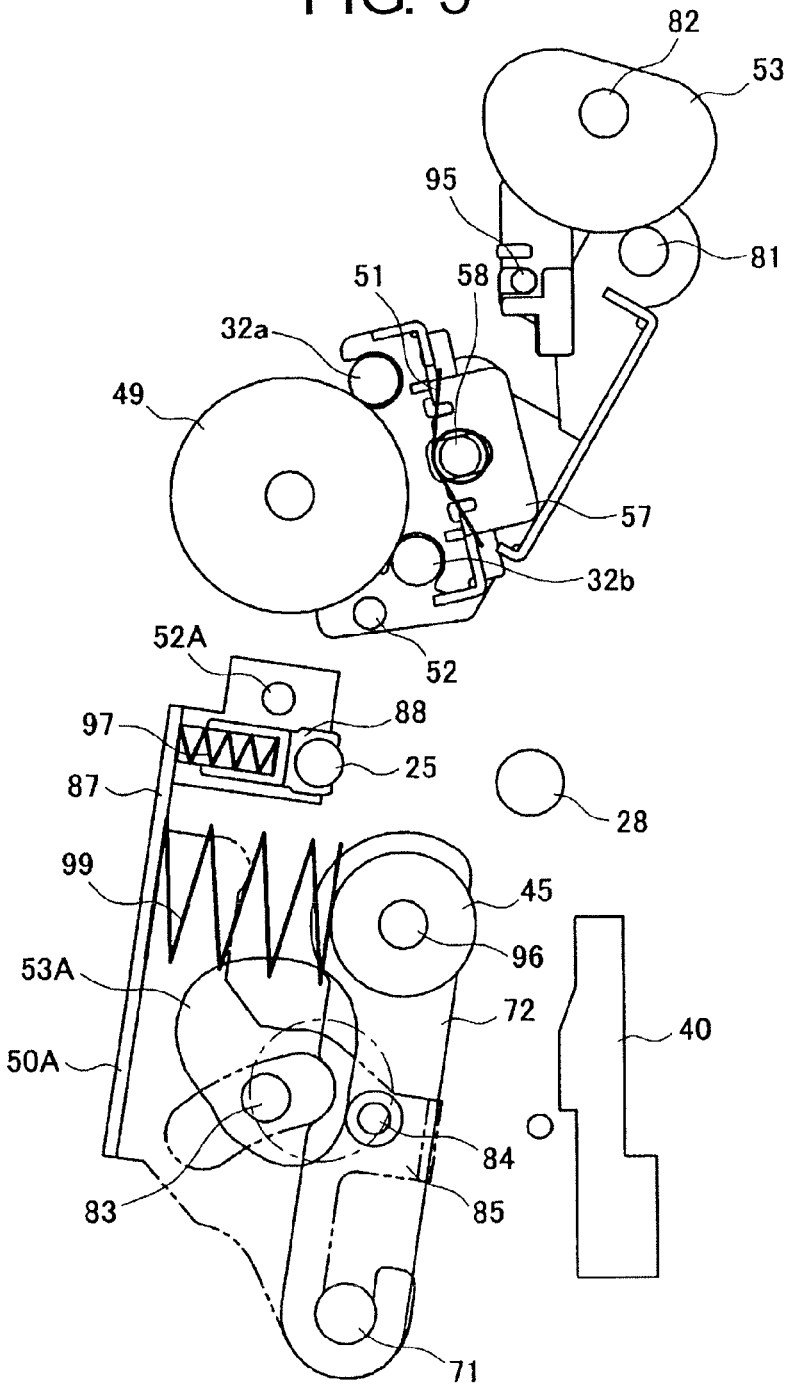
FIG. 5 is an explanatory view of a control state by the cam in a transport position in which the pinch rollers and film transport roller are brought into contact with each other, and the platen roller and thermal head are brought into contact with each other.
Figure 10:
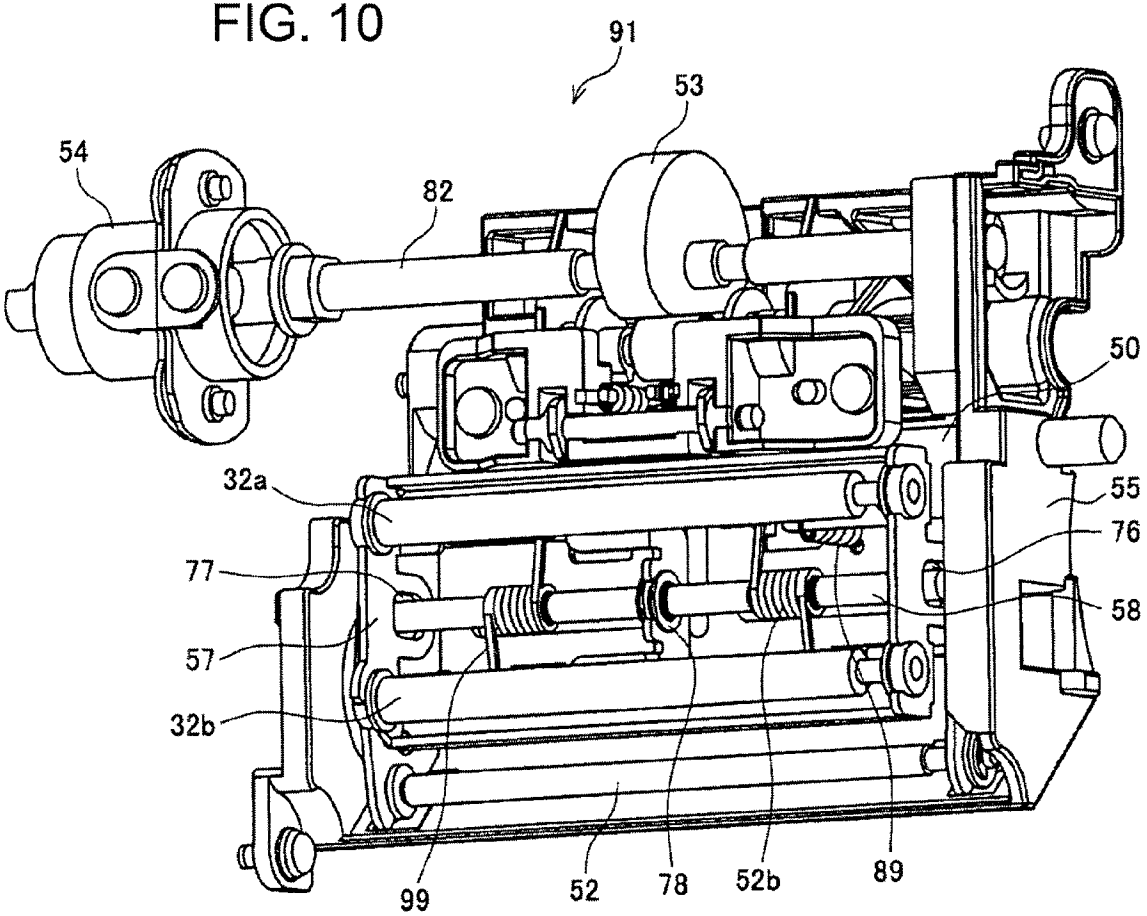
FIG. 10 is an outside view showing a configuration of a second unit integrated to incorporate the pinch rollers and their peripheral parts into the printing apparatus.

The configuration of the first transfer section will specifically be described further together with its action. As shown in FIGS. 3 to 5, the pinch rollers 32*a*, 32*b* are respectively supported by an upper end portion and lower end portion of a pinch roller support member 57, and the pinch roller support member 57 is supported rotatably by a support shaft 58 penetrating the center portion of the member 57. As shown in FIG. 10, the support shaft 58 is laid at its opposite end portions between long holes 76, 77 provided in the pinch roller support member 57, and is at its center portion fixed to a fix portion 78 of a bracket 50. Further, the long holes 76, 77 are provided with spaces in the horizontal direction and vertical direction with respect to the support shaft 58. Accordingly, it is made possible to adjust the pinch rollers 32*a*, 32*b* with respect to the film transport roller 49, described later.

Then, spring members 51 (51*a*, 51*b*) are mounted on the support shaft 58, and end portions on which the pinch rollers 32*a*, 32*b* are installed of the pinch roller support member 57 respectively contact the spring members 51, and are biased to the direction of the film transport roller 49 by the spring forces.

The bracket 50 comes into contact with the cam operation surface of a cam 53 in a cam receiver 81, and is configured to shift in the horizontal direction viewed in the figure with respect to the film transport roller 49, corresponding to rotation in the arrow direction of the cam 53 with a cam shaft 82 as the axis driven by a drive motor 54 (see FIG. 10). Accordingly, when the bracket 50 moves toward the film transport roller 49 (FIGS. 4 and 5), the pinch rollers 32*a*, 32*b* come into press-contact with the film transport roller 49 against the spring members 51 with the transfer film 46 nipped, and wind the transfer film 46 around the film transport roller 49.

At this point, the pinch roller 32*b* in a farther position from a shaft 95 as a rotation axis of the bracket 50 first comes into press-contact with the film transport roller 49, and next, the pinch roller 32*a* comes into press-contact. In this way, by arranging the shaft 95 that is the rotation axis higher than the film transport roller 49, the pinch roller support member 57 comes into contact with the film transport roller 49 while rotating, instead of parallel shift, and there is the advantage that the space in the width direction is less than in the parallel shift.

Further, the press-contact forces when the pinch rollers 32*a*, 32*b* come into press-contact with the film transport roller 49 are uniform in the width direction of the transfer film 46 by the spring members 51. At this point, since the long holes 76, 77 are provided on the opposite sides of the pinch roller support member 57 and the support shaft 58 is fixed Lo the fix portion 78, it is possible to adjust the pinch roller support member 57 in three directions, and the transfer film 46 is transported in a correct posture by rotation of the film transport roller 49 without causing skew. In other words, adjustments in three directions described herein are to (i) adjust the parallel degree in the horizontal direction of the shafts of the pinch rollers 32*a*, 32*b* with respect to the shaft of the film transport roller 49 to uniform the press-contact forces in the shaft direction of the pinch rollers 32*a*, 32*b* with respect to the film transport roller 49, (ii) adjust shift distances of the pinch rollers 32*a*, 32*b* with respect to the film transport roller 49 to uniform the press-contact force of the pinch roller 32*a* on the film transport roller 49 and the press-contact force of the pinch roller 32*b* on the film transport roller 49, and (iii) adjust the parallel degree in the vertical direction of the shafts of the pinch rollers 32*a*, 32*b* with respect to the shaft of the film transport roller 49 so that the shafts of the pinch rollers 32*a*, 32*b* are perpendicular to the film travel direction.

Then, the bracket 50 is provided with a tension receiving member 52 that comes into contact with a portion of the transfer film 46 which is not wound around the film transport roller 49 when the bracket 50 moves toward the film transport roller 49.

The tension receiving member 52 is provided to prevent the pinch rollers 32*a*, 32*b* from retracting from the film transport roller 49 respectively against the biasing forces of the spring members 51 due to the tension of the transfer film 46 occurring when the pinch rollers 32*a*, 32*b* bring the transfer film 46 into press-contact with the film transport roller 49. Accordingly, the tension receiving member 52 is attached to the front end of the end portion on the rotation side of the bracket 50 so as to come into contact with the transfer film 46 in the position to the left of the pinch rollers 32*a*, 32*b* viewed in the figure. FIG. 2 shows a state in which the tension receiving member 52 is brought into contact with the transfer film 46.

By this means, the cam 53 is capable of directly receiving the tension occurring due to elasticity of the transfer film 46 through the tension receiving member 52. Accordingly, the pinch rollers 32*a*, 32*b* are prevented from retracting from the film transport roller 49 due to the tension and from decreasing the press-contact forces of the pinch rollers 32*a*, 32*b*, thereby maintain the winding state in which the transfer film 46 is brought into intimate contact with the film transport roller 49, and are able to perform accurate transport.

Figure 9:
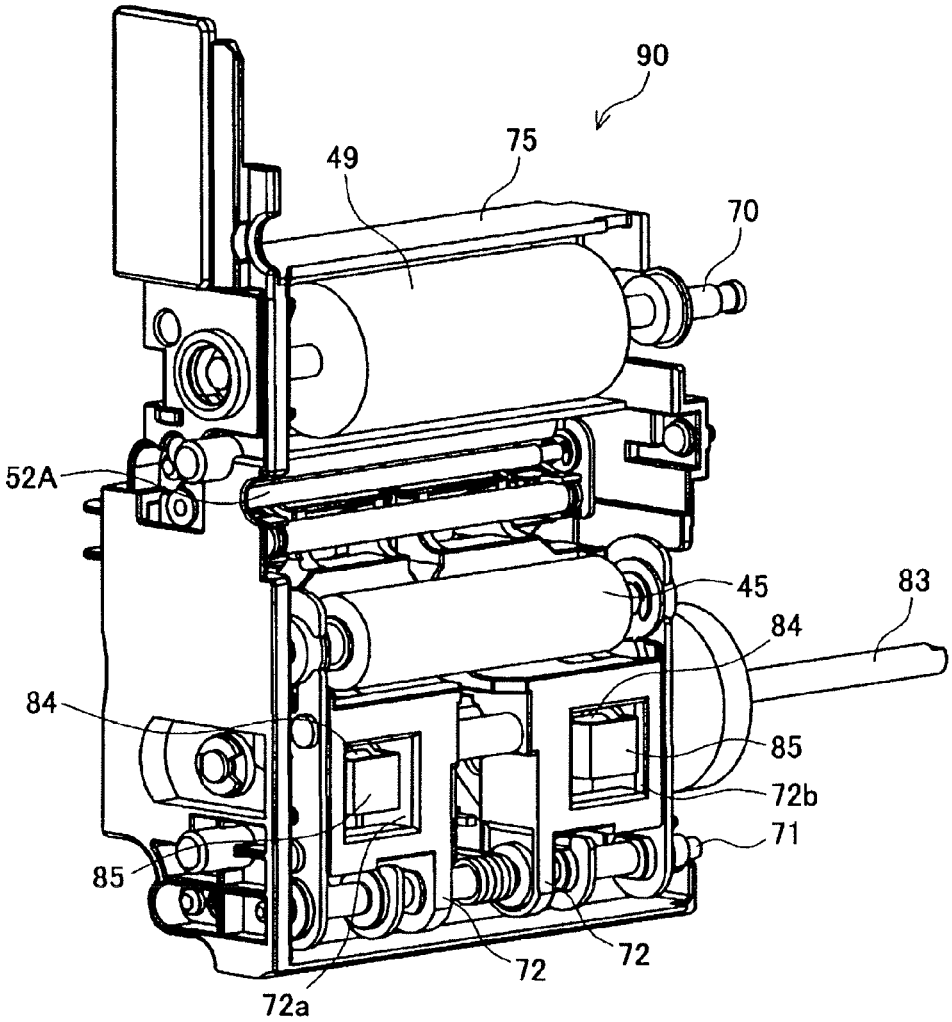
FIG. 9 is an outside view showing a configuration of a first unit integrated to incorporate the film transport roller, platen roller and their peripheral parts into the printing apparatus.

As shown in FIG. 9, the platen roller 45 disposed along the transverse width direction of the transfer film 46 is supported by a pair of platen support members 72 rotatable on a shaft 71 as the axis. The pair of platen support members 72 support opposite ends of the platen roller 45. The platen support members 72 are respectively connected to end portions of a bracket 50A having the shaft 71 as a common rotating shaft via spring members 99.

The bracket 50A is comprised of a substrate 87, and cam receiver support portion 85 formed by bending the substrate 87 in the direction of the platen support member 72, and the cam receiver support portion 85 holds a cam receiver 84. Then, a cam 53A rotating on a cam shaft 83 as the axis driven by the drive motor 54 is disposed between the substrate 87 and the cam receiver support portion 85, and is configured so that the cam operation surface and cam receiver 84 come into contact with each other. Accordingly, when the bracket 50A moves in the direction of the thermal head 40 by rotation of the cam 53A, the platen support members 72 also shift to bring the platen roller 45 into press-contact with the thermal head 40.

The spring members 99 and cam 53A are thus disposed vertically between the bracket 50A and platen support members 72, and it is thereby possible to store the platen shift unit within the distance between the bracket 50A and platen support members 72. Further, the width direction is held within the width of the platen roller 45, and it is possible to save space.

Moreover, since the cam receiver support portion 85 is fitted into bore portions 72*a*, 72*b* (see FIG. 9) formed in the platen support members 72, even when the cam receiver support portion 85 is formed while protruding in the direction of the platen support members 72, the distance between the bracket 50A and the platen support members 72 is not increased, and also in this respect, it is possible to save space.

When the platen roller 45 comes into press-contact with the thermal head 40, the spring members 99 connected to respective platen support members 72 act each so as to uniform the press-contact force on the width direction of the transfer film 46. Accordingly, when the transfer film 46 is transported by the film transport roller 49, the skew is prevented, and it is possible to perform thermal transfer by the thermal head 40 accurately without the printing region of the transfer film 46 shifting in the width direction.

The substrate 87 of the bracket 50A is provided with a pair of peeling roller support members 88 for supporting opposite ends of the peeling roller 25 via spring members 97, and when the bracket 50A moves to the thermal head 40 by rotation of the cam 53A, the peeling roller 25 comes into contact with the peeling member 28 to peel off the transfer film 46 and ink ribbon 41 nipped between the roller and member. The peeling roller support members 88 are also provided respectively at opposite ends of the peeling roller 25 as in the platen support members 72, and are configured so as to uniform the press-contact force in the width direction on the peeling member 28.

A tension receiving member 52A is provided in an end portion on the side opposite to the end portion on the shaft support 59 side of the bracket 50A. The tension receiving member 52A is provided to absorb the tension of the transfer film 46 occurring in bringing the platen roller 45 and peeling roller 25 respectively into press-contact with the thermal head 40 and peeling member 28. The spring members 99 and 97 are provided so as to uniform the press-contact force on the width direction of the transfer film 46, and in order for the spring members 99 and 97 not to be inversely behind the tension of the transfer film 46 and decrease the press-contact force on the transfer film 46, the tension receiving member 52A receives the tension from the transfer film 46. In addition, since the tension receiving member 52A is also fixed to the bracket 50A as in the above-mentioned tension receiving member 52, the cam 53A receives the tension of the transfer film 46 via the bracket 50A, and is not behind the tension of the transfer film 46. By this means, the press-contact force of the thermal head 40 and platen roller 45 and the press-contact force of the peeling member 28 and peeling roller 25 are held, and it is thereby possible to perform excellent printing and peeling. Further, any error does not occur in the transport amount of the transfer film 46 in driving the film transport roller 49, the transfer film 46 corresponding to the length of the printing region is accurately transported to the thermal head 40, and it is possible to perform printing with accuracy.

The cam 53 and cam 53A are driven by same drive motor 54 with a belt 98 (see FIG. 3) laid therebetween.

Figure 6:
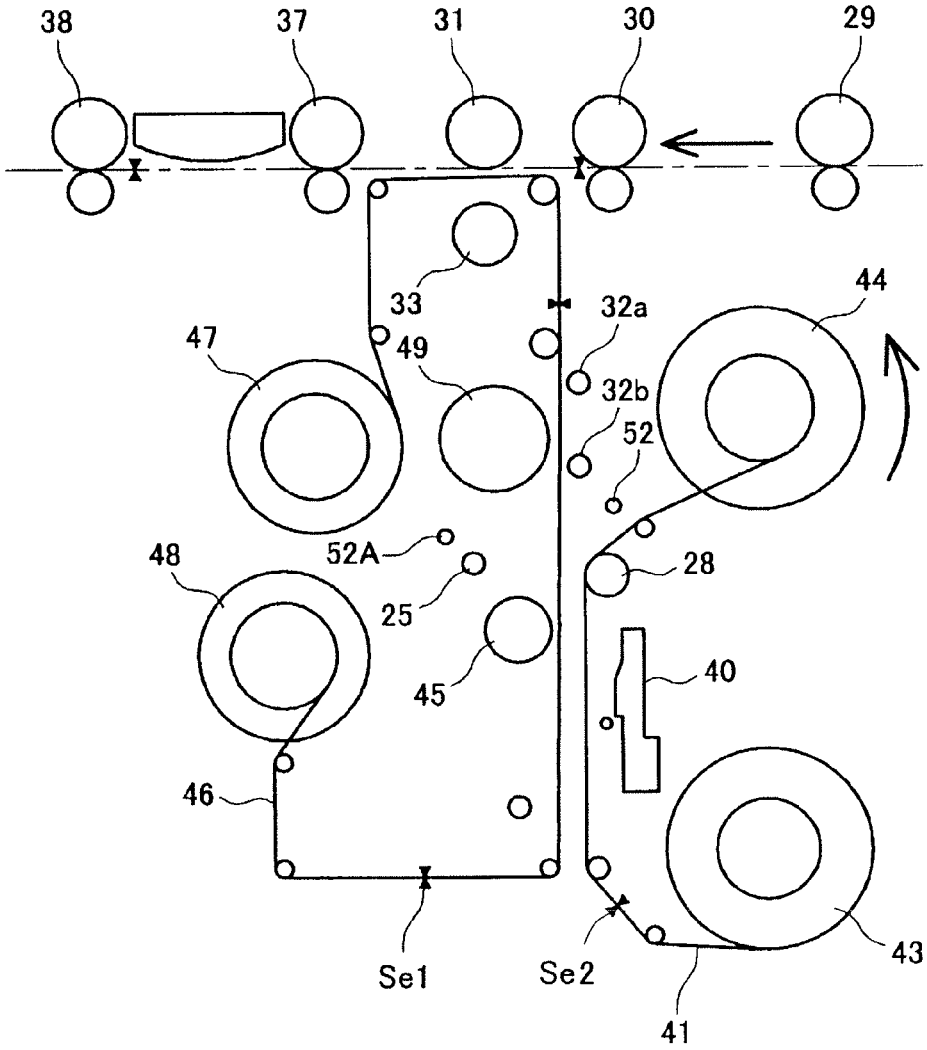
FIG. 6 is an operation explanatory view to explain the state of the waiting position in the printing apparatus.

When the image formation section B is in such a waiting position as shown in FIG. 6, the cam 53 and cam 53A are in the state as shown in FIG. 3, the pinch rollers 32*a*, 32*b* are not brought into press-contact with the film transport roller 49, and the platen roller 45 is not brought into press-contact with the thermal head 40 either.

Figure 7:
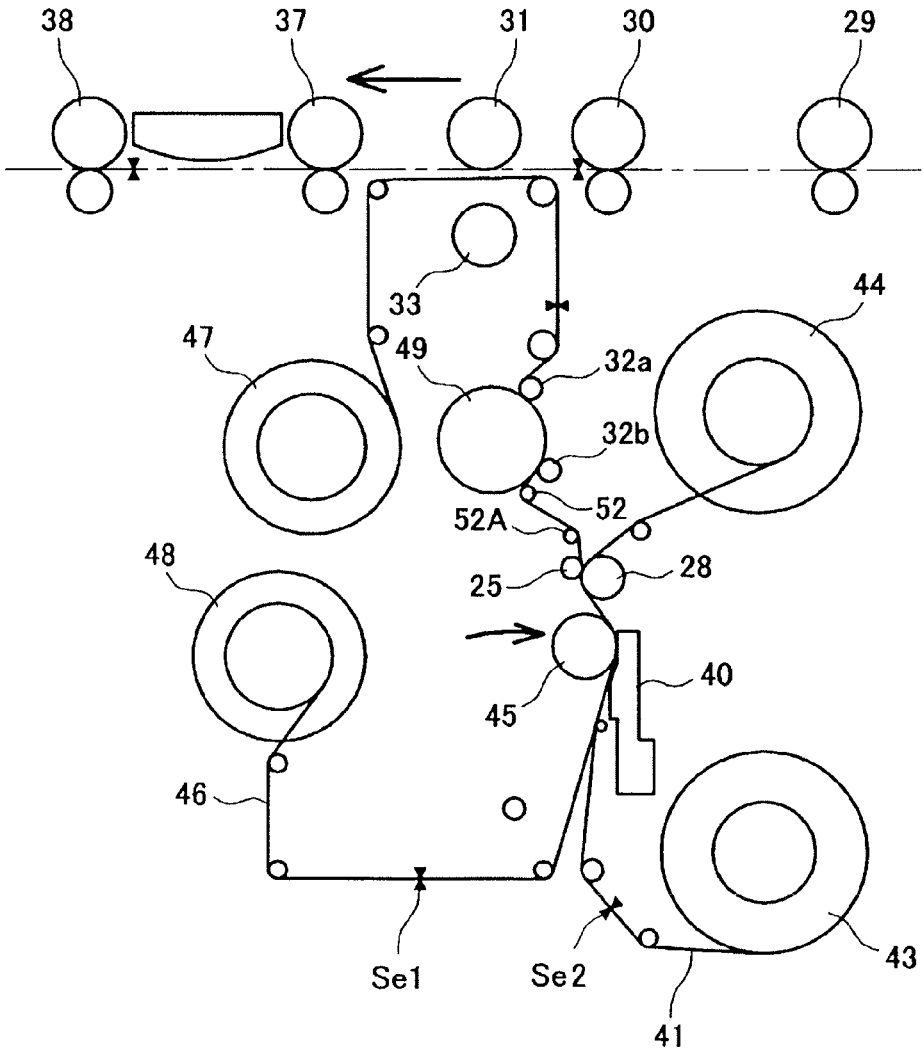
FIG. 7 is an operation explanatory view to explain the state of the transport position in the printing apparatus.

Then, when the cam 53 and cam 53A are rotated in conjunction with each other and are in the state as shown in FIG. 4, the image formation section B shifts to a printing position as shown in FIG. 7. At this point, the pinch rollers 32*a*, 32*b* first wind the transfer film 46 around the film transport roller 49, and concurrently, the tension receiving member 52 comes into contact with the transfer film 46. Subsequently, the platen roller 45 comes into press-contact with the thermal head 40. In this printing position, the plate roller 45 shifts toward the thermal head 40 to nip the transfer film 46 and ink ribbon 41 and come into press-contact, and the peeling roller 25 is in contact with the peeling member 28.

In this state, when transport of the transfer film 46 is started by rotation of the film transport roller 49, at the same time, the ink ribbon 41 is also wound around the wind-up spool 44 by operation of the motor Mr1 and transported in the same direction. During this transport, a positioning mark provided in the transfer film 46 passes through a sensor Se and shifts a predetermined amount, and at the time the transfer film 46 arrives at a printing start position, printing by the thermal head 40 is performed on the predetermined region of the transfer film 46. Particularly, since the tension of the transfer film 46 is large during printing, the tension of the transfer film 46 acts on the direction for separating the pinch rollers 32*a*, 32*b* from the film transport roller 49 and the direction for separating the peeling roller 25 and platen roller 45 from the peeling member 28 and thermal head 40. However, as described above, since the tension of the transfer film 46 is received in the tension receiving members 52, 52A, the press-contact forces of the pinch rollers 32*a*, 32*b* are not decreased, it is thereby possible to perform accurate film transport, the press-contact force of the thermal head 40 and platen roller 45 and the press-contract force of the peeling member 28 and peeling roller 25 are not decreased either, and it is possible to perform accurate printing and peeling. The ink ribbon 41 with which printing is finished is peeled off from the transfer film 46 and wound around the wind-up spool 44.

A shift amount by transport of the transfer film 46 i.e. a length in the transport direction of the printing region Lo undergo printing is detected by an encoder (not shown) provided in the film transport roller 49, rotation of the film transport roller 49 is halted corresponding to detection, and at the same time, winding by the wind-up spool 44 by operation of the motor Mr2 is also halted. By this means, finished is printing of the first color on the printing region of the transfer film 46 with the thermal head 40.

Figure 8:
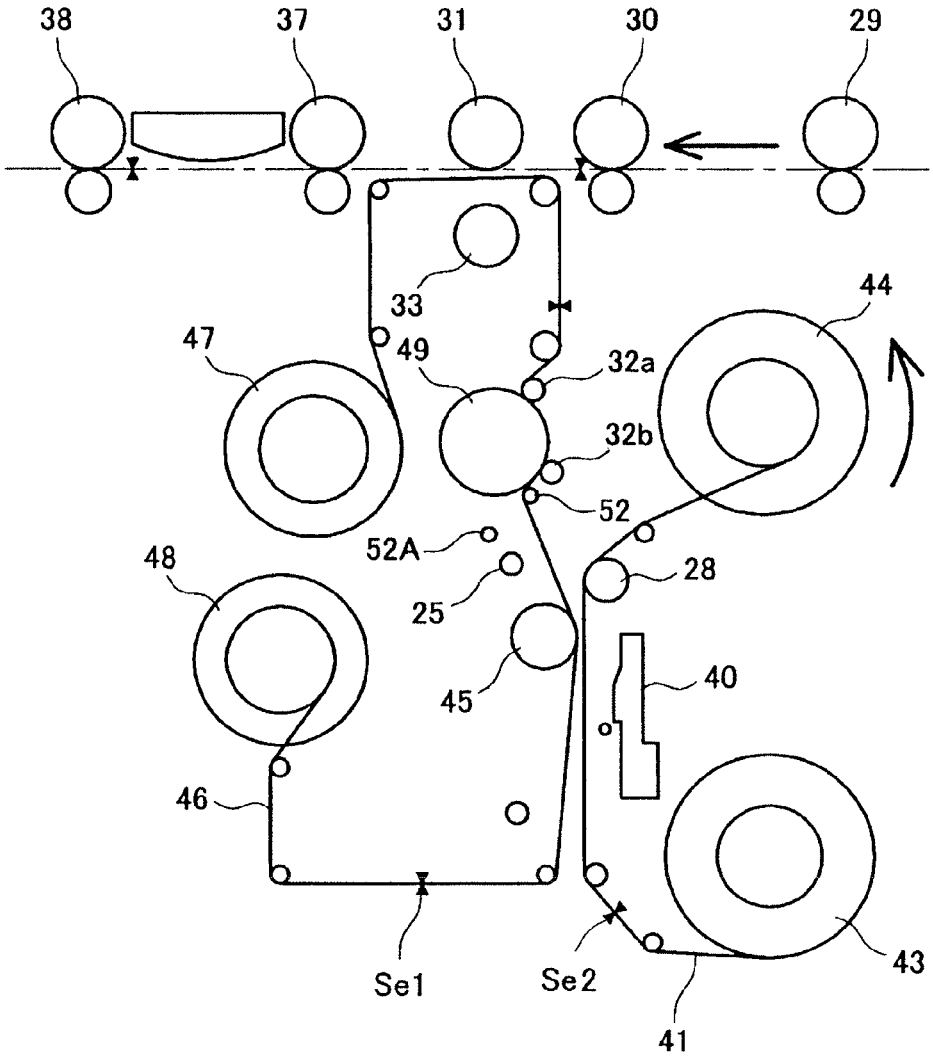
FIG. 8 is an operation explanatory view to explain the state of the printing position in the printing apparatus.

Then, when the cam 53 and cam 53A are further rotated in conjunction with each other and are in the state as shown in FIG. 5, the image formation section B shifts to a transport position as shown in FIG. 8, and the platen roller 45 returns to the direction of retracting from the thermal head 40. In this state, the pinch rollers 32*a*, 32*b* still wind the transfer film 46 around the film transport roller 49, the tension receiving member 52 is in contact with the transfer film 46, and the transfer film 46 is transported backward to an initial position by rotation in the backward direction of the film transport roller 49. Also at this point, the shift amount of the transfer film 46 is controlled by rotation of the film transport roller 49, and the transfer film 46 is transported backward corresponding to the length in the transport direction of the printing region subjected to printing. In addition, the ink ribbon 41 is rewound a predetermined amount with the motor Mr3, and the panel of the color to print next waits in the initial position (feeding position).

Then, the control state by the cam 53 and cam 53A becomes the state as shown in FIG. 4 again and the printing position as shown in FIG. 7, the platen roller 45 is brought into press-contact with the thermal head 40, the film transport roller 49 rotates in the forward direction again to shift the transfer film 46 corresponding to the length of the printing region, and printing with the next color is performed with the thermal head 40.

Thus, the operation in the printing position and transport position is repeated until printing of all colors (in this Embodiment, four colors of Y (Yellow), M (Magenta), C (Cyan) and Bk (Black)) is finished. Then, when printing (first transfer) with the thermal head 40 is finished, the first-transferred region of the transfer film 46 is transported to the heat roller 33, and at this point, the cam 53 and cam 53A shift to the state as shown in FIG. 3, and release press-contact with the transfer film 46. In subsequent second transfer, transfer to the card is performed while transporting the transfer film by driving of the wind-up spool 47.

Such an image formation section B is divided into three units 90, 91, 92 and each is integrated.

In the first unit 90 as shown in FIG. 9, a unit frame body 75 is installed with a drive shaft 70 that rotates by driving of the motor 54 (see FIG. 10), and the driving shaft 70 is inserted in the film transport roller 49. Below the film transfer film 49 are disposed the bracket 50A and a pair of platen support members 72, and these members are supported rotatably by the shaft 71 laid between opposite side plates of the unit frame body 75.

In FIG. 9, a pair of cam receiver support portions 85 that are a part of the bracket 50A appear from the bore portions 72*a*, 72*b* formed in the platen support members 72. The cam receiver support portions 85 hold a pair of cam receivers 84 disposed at the back thereof. Then, at the back of the cam receivers 84 is disposed the cam 53A installed in the camshaft 83 inserted in the unit frame body 75. The camshaft 83 is laid between opposite side plates of the unit frame body 75.

Figure 11:
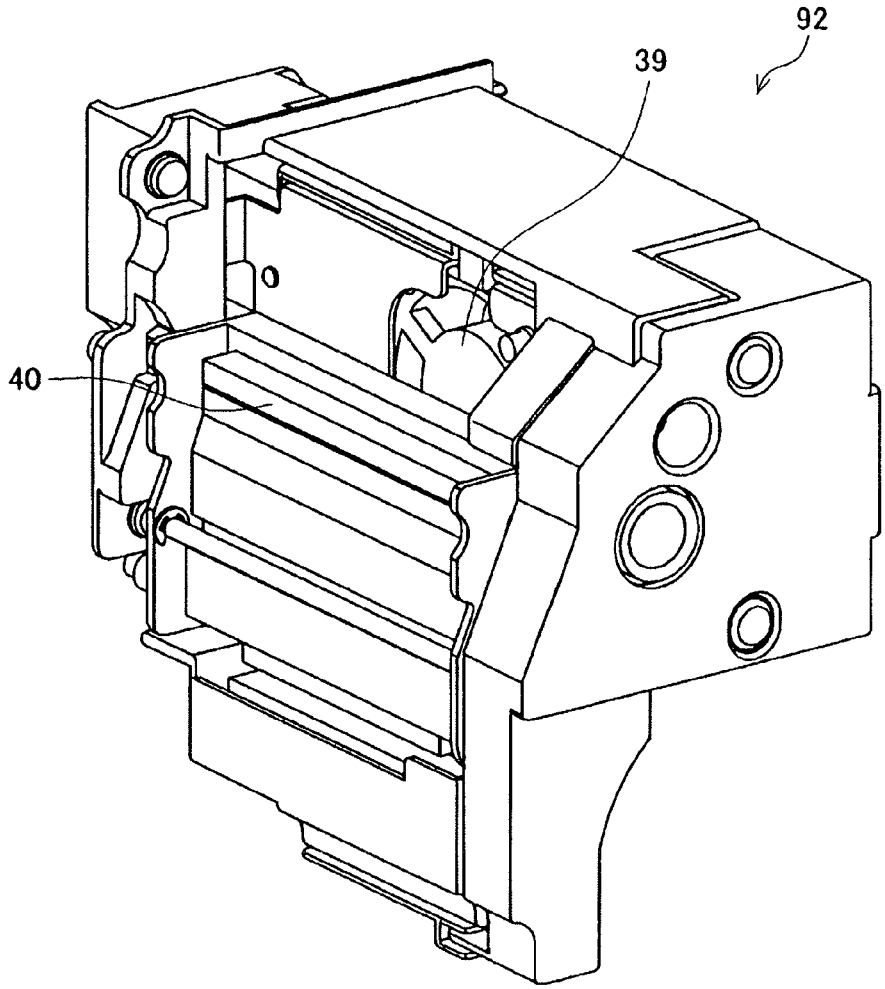
FIG. 11 is an outside view of a third integrated to incorporate the thermal head into the printing apparatus.

The thermal head 40 is disposed in the position opposed to the platen roller 45 with a transport path of the transfer film 46 and ink ribbon 41 therebetween. The thermal head 40, members related to heating and cooling fan 39 are integrated into the third unit 92 as shown in FIG. 11, and are disposed opposite the first unit 90.

The first unit 90 collectively holds the platen roller 45, peeling roller 25 and tension receiving member 52A varying in position by printing operation in the movable bracket 50A, and thereby eliminates the need of position adjustments among the members. Moreover, by shifting the bracket 50A by rotation of the cam 53, it is possible to shift the members to predetermined positions. Further, since the bracket 50A is provided, it is possible to store in the same unit as that of the fixed film transport roller 49, the transport drive portion by the film transport roller 46 required to transport the transfer film with accuracy and the transfer position regulation portion by the platen roller 45 are included in the same unit, and therefore, the need is eliminated for position adjustments between both portions.

In the second unit 91 as shown in FIG. 10, the cam shaft 82 installed with the cam 53 is inserted in a unit frame body 55, and is coupled to an output shaft of the drive motor 54. Then, the second unit 91 supports the bracket 50 in the unit frame body 55 movably to come into contact with the cam 53, and to the bracket 50 are fixed the support shaft 58 that supports the pinch roller support member 57 rotatably and the tension receiving member 52.

In the pinch roller support member 57, the spring members 51*a*, 51*b* are attached to the support shaft 58, and their end portions are respectively brought into contact with the opposite ends of the pinch roller support member 57 that supports the pinch rollers 32*a*, 32*b* to bias to the direction of the film transport roller 49. Then, in the pinch roller support member 57, the support shaft 58 is inserted in the long holes 76, 77, and is fixed and supported in the center portion by the bracket 50.

A spring 89 for biasing the pinch roller support member 57 toward the bracket 50 is provided between the bracket 50 and the pinch roller support member 57. By this spring 89, the pinch roller support member 57 is biased in the direction of moving backward from the film transport roller 49 of the first unit 90, and therefore, it is possible to easily pass the transfer film 46 through between the first unit 90 and the second unit 91 in setting the transfer film cassette in the printing apparatus 1.

The second unit 91 holds the pinch rollers 32*a*, 32*b*, and tension receiving member 52 varying in position corresponding to printing operation in the bracket 50A, shifts the pinch rollers 32*a*, 32*b*, and tension receiving member 52 by shifting the bracket 50A by rotation of the cam 53, and thereby simplifies position adjustments between the rollers and member, and position adjustments between the pinch rollers 32*a*, 32*b* and the film transport roller 49. Such a second unit 91 is disposed opposite the first unit 90 with the transfer film 46 therebetween.

By thus making the units, it is also possible to pull each of the first unit 90, second unit 92 and third unit 93 out of the main body of the printing apparatus 1 as in the cassette of each of the transfer film 46 and ink ribbon 41. Accordingly, in replacing the cassette due to consumption of the transfer film 46 or ink ribbon 41, when the units 90, 91 and 92 are pulled out as required, it is possible to install the transfer film 46 or ink ribbon 41 readily inside the apparatus in inserting the cassette.

As described above, by combining the first unit 90 into which are integrated the platen roller 45, bracket 50A, cam 53A, and platen support member 72, and the second unit 91 into which are integrated the pinch rollers 32*a*, 32*b*, bracket 50, cam 53 and spring members 51, and placing and installing the third unit 92 with the thermal head 40 attached thereto opposite the platen roller 45, it is possible to perform assembly in manufacturing the printing apparatus and adjustments in maintenance with ease and accuracy. Moreover, by integrating, it is possible to perform removal from the apparatus with ease, and the handleability as the printing apparatus is improved.

<Ink Ribbon Cassette>

Figure 12:
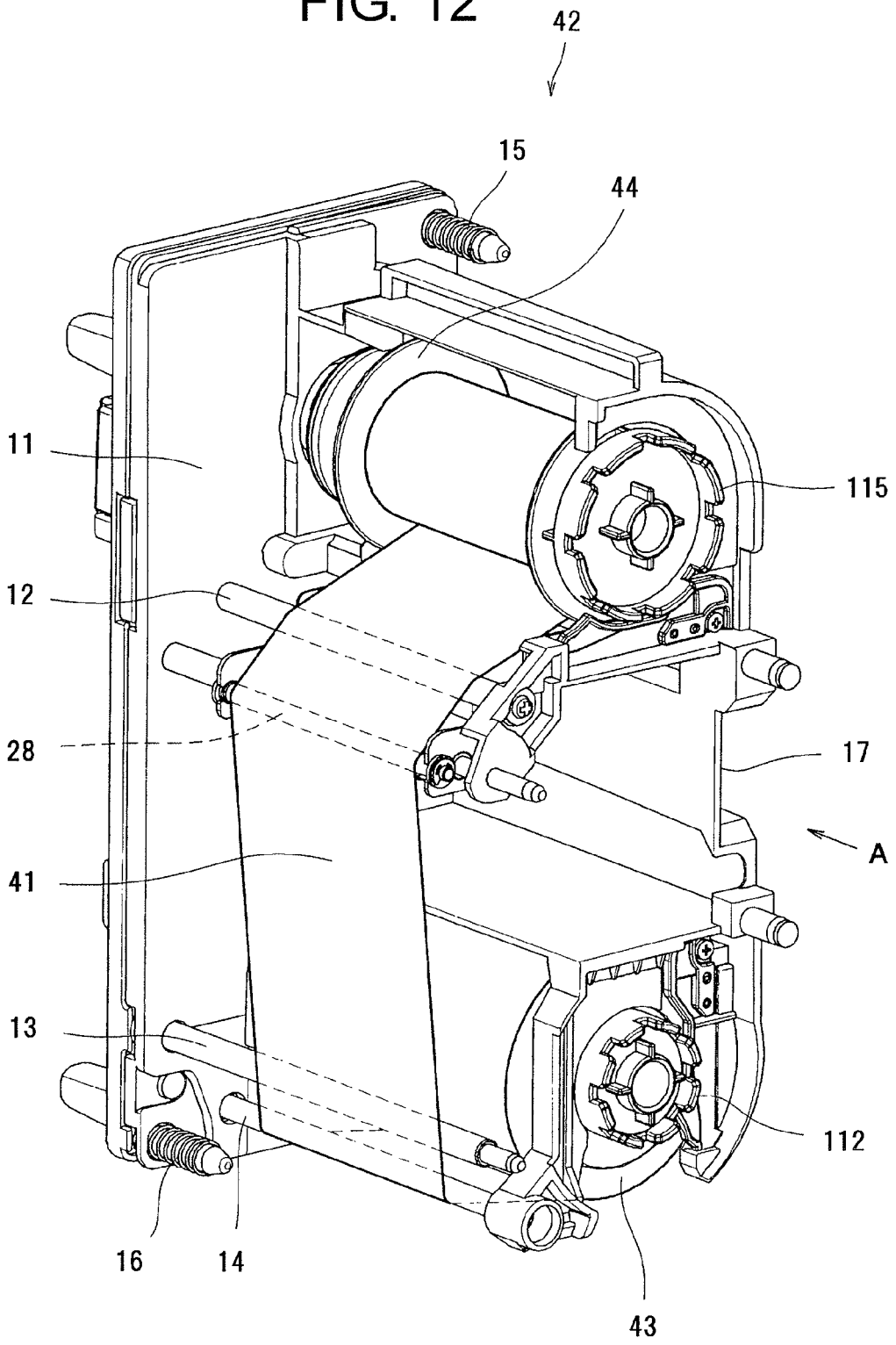
FIG. 12 is an outside perspective view of a ribbon cassette.

The cassette 42 storing the ink ribbon 41 will specifically be described next. As shown in FIG. 12, the cassette 42 has a base 11 in the shape of a rectangular plate that is a base bench of the cassette 42. Main-body connection protrusions 15, 16 to insert in the main-body apparatus (printing apparatus 1)

protrude in the base 11. Springs are wound around the main-body insertion protrusions 15, 16, and by the springs, the cassette is slidably inserted in the main-body apparatus.

The wind-up spool 44 is disposed rotatably on one side (upper side in FIG. 12) in the longitudinal direction of the base 11, and the supply spool 43 is disposed rotatably on the other side (lower side in FIG. 12) in the longitudinal direction of the base 11. In other words, on one side and the other side of the base 11 are formed circular through holes for axially supporting shafts (see reference numeral "119" in FIG. 13) on one side of the wind-up spool 44 and supply spool 43 rotatably, respectively. The wind-up spool 44 has an engagement portion 115 with a large diameter on the other side of the shaft, and the supply spool 43 has an engagement portion 112 with a diameter smaller than that of the engagement portion 115 on the other side of the shaft 119. The reason why the diameters are thus different between the engagement portion 115 and the engagement portion 112 is to prevent erroneous insertion in the vertical direction shown in FIG. 12 in inserting the cassette 42 in the main-body apparatus.

Further, the cassette 42 has a cover 17 that covers the wind-up spool 44 and the supply spool 43 in the direction crossing the base 11. The cover 17 is fixed to the end portion along the longitudinal direction of the base 11. Further, from the lower side to upper side in FIG. 12, in the cassette 42 are disposed shafts 14, 13, shaft-shaped peeling member 28, and shaft 12 to be parallel with the shaft line of the supply spool 43 or wind-up spool 44. These shafts are fixed on one side to the base 11, while being fixed on the other side to extension portions extending to be opposed to Lhe base 11 from the cover 17.

Accordingly, the ink ribbon 41 fed out of the supply spool 43 is transported to come into slide-contact on one surface side with the shafts 14, 13, peeling member 28 and shaft 12 to be wound around the wind-up spool 44, or inversely, to come into slide-contact with the shaft 12, peeling member 20 and shafts 14, 13 to be wound around the supply spool 43.

Described herein is the arrangement relationship between the sensor Se2 and thermal head 40 on the main-body side and the shafts when the cassette 42 is inserted in the main-body apparatus. As shown in FIG. 16A, the sensor Se2 is positioned in between the shaft 14 and the shaft 13 along the ink ribbon 41 fed out of the supply spool 43, and the thermal head 40 is positioned in between the shaft 13 and the peeling member 28.

Described further is the relationship among the ink ribbon 41, supply spool 43, wind-up spool 44 and the like when the cassette 42 is inserted in the main-body apparatus. The length of the ink ribbon 41 laid between the supply spool 43 and the wind-up spool 44 is set to be shorter than the total length of three ribbon panels among ribbon panels of successive four colors of Y (Yellow), M (Magenta), C (Cyan) and Bk (Black), and further, along the ink ribbon 41 laid between the supply spool 43 and the wind-up spool 44, each of the distance between the supply spool 43 and the sensor Se2, the distance between the sensor Se2 and the thermal head 40, the distance between the thermal head 40 and the peeling member 28, and the distance between the peeling member 28 and the wind-up spool 44 is set to be shorter than the length of a ribbon panel of one color of the ink ribbon 41.

<Engagement of the Spool Main Body and Main-Body Apparatus>

Figure 13:
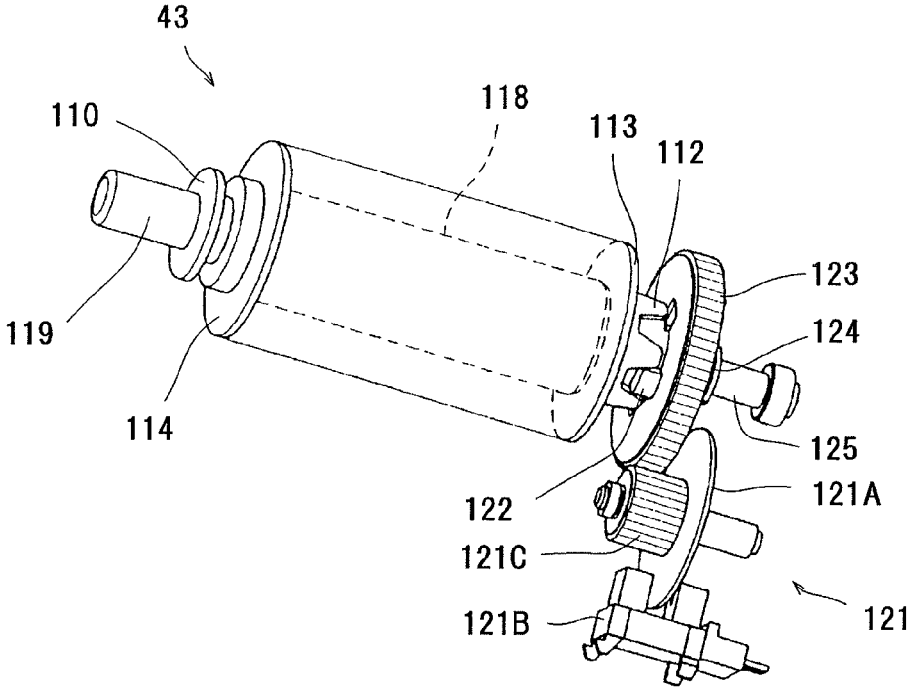
FIG. 13 is a perspective view showing an engagement state of a supply spool and the main body side.

With reference to FIG. 13, described next are a spool main body 110 on the supply spool 43 side and an engagement portion of the printing apparatus 1 to engage in the spool main body 110. FIG. 13 shows an engagement state of the engagement portion 112 of the supply spool 43 and an engagement member (engagement convex portion 122) on the main-body apparatus side. An engagement state of the engagement portion of the wind-up spool 44 and an engagement member on the main-body apparatus is the same, the supply spool 43 is therefore only described, and the description on the wind-up spool 44 is omitted. The engagement portion 112 has eight rectangular convex portions protruding in the direction of the end portion. In addition, in the supply spool 43 and wind-up spool 44 shown in FIG. 12, the ink ribbon 41 is wound around (held by) the respective spool main body 110, an unused portion of the ink ribbon 41 is wound around the supply spool 43, and a used portion of the ink ribbon 41 (ink ribbon 41 subjected to thermal transfer with the thermal head 40) is wound around the wind-up spool 44.

The spool main body 110 has a cylindrical ribbon holding portion 118 having fringes 113, 114 at opposite ends to hold the ink ribbon 41, the engagement portion 112 provided on one end portion adjacent to the fringe 113, and a shaft portion 119 with a diameter smaller than that of the cylindrical portion of the ribbon holding portion 118 provided on the side opposite to the engagement portion 112 adjacent to the fringe 114.

The fringes 113, 114 regulate the position of winding of the ink ribbon 41 around the ribbon holding portion 118 in the shaft direction of the spool main body 110. Therefore, when the spool main body 110 rotates, an unused ink ribbon 41 is supplied from the ribbon holding portion 118 without causing misregistration (in the case of the supply spool 43), and a used portion of the ink ribbon 41 is properly wound around the ribbon holding portion on the wind-up side (in the case of the wind-up spool 44).

The engagement portion on the main-body apparatus side associated with the engagement portion 112 of the supply spool 43 is comprised of a plurality of members. In other words, a support shaft 125 is fixed to the housing 2, and axially supports the disk-shaped engagement member having a gear on the outer edge portion to be rotatable. On the side engaging in the engagement portion 112 of the engagement member, two engagement convex portions 122 of shapes different from the convex portion (groove portion) of the engagement portion 112 are provided to protrude opposite each other (so as to make a phase difference of 180° with respect to the rotation direction of the engagement portion). In the engagement portion 122 is formed a groove formed from an inclined surface linearly formed on the convex-portion side surface having a predetermined inclined angle, and a bottom portion connecting between adjacent convex-portion inclined surfaces (in FIG. 13, the relationship between the engagement portion 112 and the convex portion of the engagement portion 112 is inverse.) Further, a spring 124 is wound around the support shaft 125, and by this spring 124, the engagement portion (engagement convex portions 122) is biased to the engagement portion side slidably. In addition, a gear 123 meshes with a gear not shown, and the driving force is transferred from the motor Mr3 to the gear that is not shown.

In inserting the cassette 42 in the main-body apparatus, there is the case that the front end of the convex portion of the engagement portion 112 of the spool main body 110 comes into contact with (hits) the front end of the engagement convex portion 122 provided in the engagement member on the apparatus main body side, and is not inserted smoothly. Since the engagement member is provided slidably in the shaft direction of the support shaft 125, when the front ends of the convex portions of the engagement portion 112 hi t the front ends of the engagement convex portions 122, the engagement convex portions 122 once retract to the apparatus frame side (on the side opposite to the spool main body 110). Subsequently, when the engagement member or spool main body 110 rotates, the engagement convex portions 122 enter into the groove between convex portions of the engagement portion 112, and are biased to the spool main body 110 side by the spring 124, and the engagement convex portions 122 and the (groove between) convex portions of the engagement portion 112 come into point-contact in two points.

The gear of the engagement member meshes with a gear 121C, and to the gear 121C is fixed a rotating plate 121A with a slit (not shown) formed on the same axis. Further, in a position to sandwich the rotating plate 121A is disposed a transmission integral-type sensor 121B comprised of a light emitting device and a light receiving device. Accordingly, the rotating plate 121A and sensor 121B constitute the encoder 121 as a rotation amount detecting means for detecting a rotation amount of the supply spool 43 that supplies the ink ribbon 41. In addition, an encoder (not shown) provided in the above-mentioned film transport roller 49 is configured in the same way. In other words, a gear that is the same as the gear 123 shown in FIG. 13 is fitted into the above-mentioned drive shaft 70 (see FIG. 9), the encoder has a gear (that corresponds to the gear 121C in FIG. 13) meshing with the gear and a rotating plate (that corresponds to the rotating plate 121A), and it is configured that rotation of the rotating plate is capable of being detected with a sensor (that corresponds to the sensor 121B in FIG. 13).

With the printing processing on the transfer film 46 with the thermal head 40, the ink ribbon 41 is transported from the supply spool 43 side to the wind-up spool 44, and according to transport, the ribbon diameter of the supply spool 43 shifts from the large diameter to the small diameter, while the ribbon diameter of the wind-up spool 43 changes from the small diameter to the large diameter. With the change, the tension in winding the ink ribbon 41 around the wind-up spool 44 shifts from high to low, and inversely, the tension in rewinding the ink ribbon 41 around the supply spool 43 shifts from low to high. Therefore, in this example, used are two motors of the motor Mr1 that is the rotation drive source of the wind-up spool 44 and motor Mr3 that is the rotation drive source of the supply spool 43, and by also using a velocity difference between these two motors, the tension of the ink ribbon 41 is adjusted. For example, in winding the ink ribbon 41 around the wind-up spool 44, the rotation velocity of the motor Mr3 is set to be slightly lower than the rotation velocity of the motor Mr1 to apply the back tension so that the ink ribbon 41 does not sag. In addition, it is assumed that forward rotation drive is the case of rotating the motors Mr1 and Mr3 in the direction in which the ink ribbon 41 is wound around the wind-up spool 44, and that backward rotation drive is the case of rotating the motors Mr1 and Mr3 in the direction in which the ink ribbon 41 is rewound around the supply spool 43.

Described next is control and electric system of the printing apparatus 1. As shown in FIG. 14, the printing apparatus 1 has a control section 100 that performs operation control of the entire printing apparatus 1, and a power supply section 120 that transforms utility AC power supply into DC power supply that enables each mechanism section, control section and the like to be driven and actuated.

<Control Section>

As shown in FIG. 14, the control section 100 is provided with a microcomputer 102 that performs entire control processing of the printing apparatus 1. The microcomputer 102 is comprised of a CPU that operates at fast clock as the central processing unit, ROM in which is stored basic control operation (programs and program data) of the printing apparatus 1, RAM that works as a work area of the CPU, and internal buses that connect the components.

The microcomputer 102 is connected to an external bus. The external bus is connected to an interface, not shown, to communicate with the higher apparatus 201, and buffer memory 101 to temporarily store printing data to print on the card, recording data to magnetically or electrically record in a magnetic stripe portion or built-in IC of the card, and the like.

Further, the external bus is connected to a sensor control section 103 that controls signals from various sensors, an actuator control section 104 that controls motor drivers and the like for outputting drive pulses and drive power to respective motors, a thermal head control section 105 to control thermal energy to heater elements constituting the thermal head 40, an operation display control section 106 to control the operation panel section 5, and the above-mentioned information recording section A.

The power supply section 120 supplies operation/drive power to the control section 100, thermal head 40, operation panel section 5 and information recording section A.

(Operation)

Printing processing operation of the printing apparatus 1 of this Embodiment will be described next mainly on the CPU (hereinafter, simply referred to as CPU) of the microcomputer 102. In addition, the entire operation of the printing apparatus 1 has already been described, and therefore, described herein is only ink ribbon transport processing by the CPU. In addition, the ink ribbon transport processing is principally performed during the printing operation.

Figure 15:
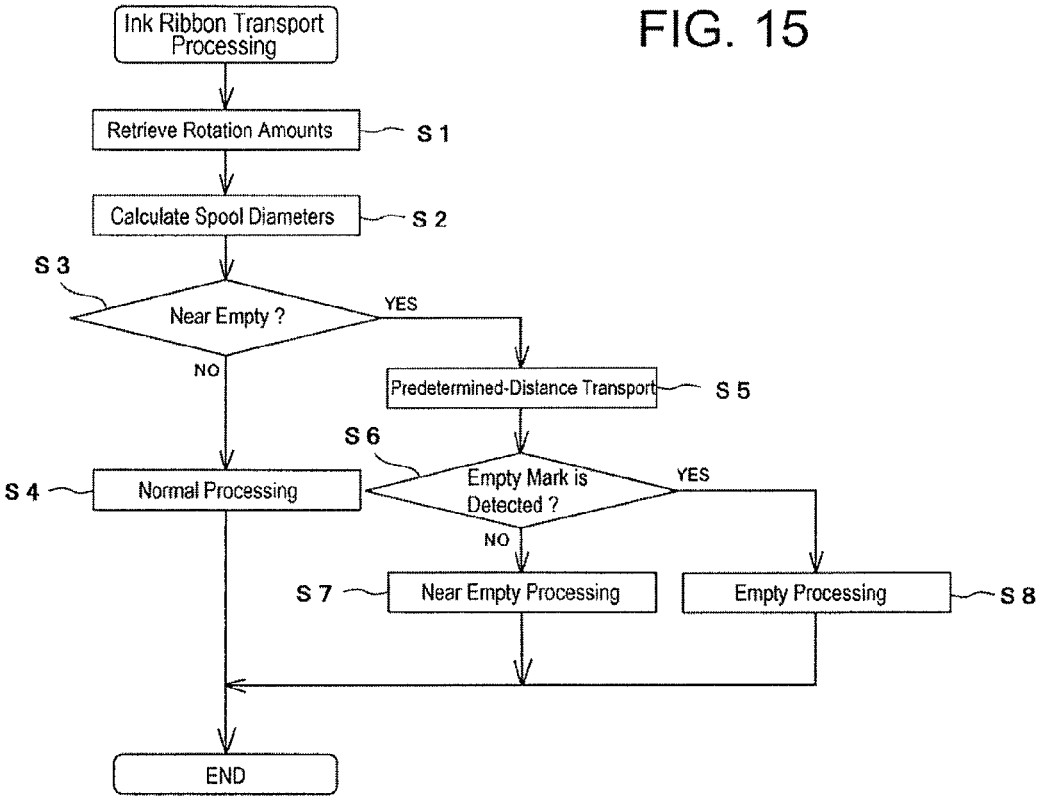
FIG. 15 is a flowchart of an ink ribbon transport processing routine executed by a CPU of a microcomputer of the control section in the printing apparatus of the Embodiment.

As shown in FIG. 15, in step S1, the CPU retrieves rotation amounts of the supply spool 43 and wind-up spool 44 detected by the encoder 121 corresponding to the printing length in the sub-scanning direction of the printing data during driving of the thermal head 40.

The image data is decomposed into color components (original data is R, G, B) on the higher apparatus 201 side, the CPU transforms R, G, B, into Y, M, C to use as the printing data prior to the printing processing with the thermal head 40, and uses Bk data set on the higher apparatus 201 side also as the same printing data of Bk in the printing apparatus 1. Based on the printing data, the CPU identifies dots matched with heating conditions to generate each printing line data, outputs the printing line data sequentially to the thermal head 40 side i.e. heating selectively heater elements lined up in the main scanning direction according to the printing line data for each printing line, and thereby drives the thermal head 40. Therefore, in generating each printing line data, the CPU is capable of grasping the longest printing length among printing lengths in the sub-scanning direction of each printing line data i.e. the printing length in the sub-scanning direction of the printing data.

In step S1, the CPU retrieves the rotation amounts of the supply spool 43 and wind-up spool 44 from outputs of the encoder 121 that counts the rotation amount of the supply spool 43 and the encoder that counts the rotation amount of the wind-up spool 44 for a period during which the thermal head 40 is driven. By this means, it is possible to detect the rotation amounts of the supply spool 43 and wind-up spool 44 of the time a certain amount (printing length in the sub-scanning direction of the printing data) of the ink ribbon 41 is transported.

In addition, it is possible to detect a shift amount by transport of transfer film 46 with the encoder provided in the film transport roller 49. During the printing operation, the transfer film 46 and ink ribbon 41 are transported at the same velocity.

Therefore, during the printing operation, when the shift amount of the transfer film 46 is grasped, it is possible to grasp also the shift amount of the ink ribbon 41. Then, whether the transfer film 46 is transported corresponding to the printing length in the sub-scanning direction of the printing data may be grasped by monitoring an output from the encoder provided in the film transport roller 49, instead of monitoring transport of the ink ribbon 41. Then, the CPU retrieves the rotation amounts of the supply spool 43 and wind-up spool 44 from outputs of the encoder 121 that counts the rotation amount of the supply spool 43 and the encoder that counts the rotation amount of the wind-up spool 44 during this transport. In this method, the printing length in the sub-scanning direction of the printing data is indirectly represented by the shift amount of the transfer film 46.

In next step S2, from the rotation amounts of the supply spool 43 and wind-up spool 44, the CPU calculates the outside diameter (hereinafter, referred to as outside diameter of the supply spool 43) of the ink ribbon 41 wound around the supply spool 43, and the outside diameter (hereinafter, referred to as outside diameter of the wind-up spool 44) of the ink ribbon 41 wound around the wind-up spool 44. As described in columns of conventional techniques, since the rotation amount is smaller as the outside diameter is thicker, while being larger as the outside diameter is thinner, the outside diameter is inversely calculated from the rotation amount.

Next, in step S3, by determining whether or not a value of the outside diameter of the supply spool 43 calculated in step S2 is smaller than a value of a beforehand set outside diameter with respect to the outside diameter of the supply spool 43, and whether or not a value of the outside diameter of the wind-up spool 44 calculated in step S2 is smaller than a value of a beforehand set outside diameter with respect to the outside diameter of the wind-up spool 44, the CPU determines whether or not the ink ribbon 41 is near empty indicative of running short. The CPU proceeds to next step S4 when both determinations are negative, while proceeding to step S5 when either or both of the determinations are positive.

In step S4, since the ink ribbon 41 is not near empty (since the usable ink ribbon (unused portion) is left sufficiently), normal processing without the need of detecting the empty mark is performed. In other words, as shown in FIG. 16A, the CPU drives the motors Mr1 and Mr3 to rotate forward so as to wind the ink ribbon 41 around the wind-up spool 44 up to a printing end position in which the rear end (rear end of the used Bk panel in this example) of the used portion of the ink ribbon 41 passes through the peeling member 28, then drives the motors Mr1 and Mr3 to rotate backward so as to rewind the ink ribbon 41 by a predetermined amount, transports the ink ribbon 41 to a feeding position to start printing of the ink panel of the next color, and finishes the ink ribbon transport processing. Since the Bk panel of the ink ribbon 41 is detected by the sensor Se2, it is possible to perform feeding of the ink panel of the next color from the rotation amount (output of the encoder 121) of the supply spool 43 from the Off edge of the Bk panel and the calculated spool diameter information. In addition, as described above, it is possible to detect the shift amount due to transport of the transfer film 46 i.e. the transport amount of the ink ribbon 41 by monitoring the encoder provided in the film transport roller 49, and therefore, by using the amount, position management between panels may be performed to feed. Further, the reason why both of the motors Mr1 and Mr3 are driven is that it is possible to perform stable transport by obtaining the desired tension with a difference in the rotation velocity between the motors and prevent skew and the like.

In addition, from the relationship between the panel length of the ink ribbon and the distance from the thermal head 40 to the peeling member 28, in the case where it is possible to start printing of the next color (Yellow) in a state in which the rear end of the Bk panel is in the printing end position, since the printing end position of the Bk panel=feeding position of the Y panel, it is not necessary to rewind the ink ribbon 41.

Figure 16B:
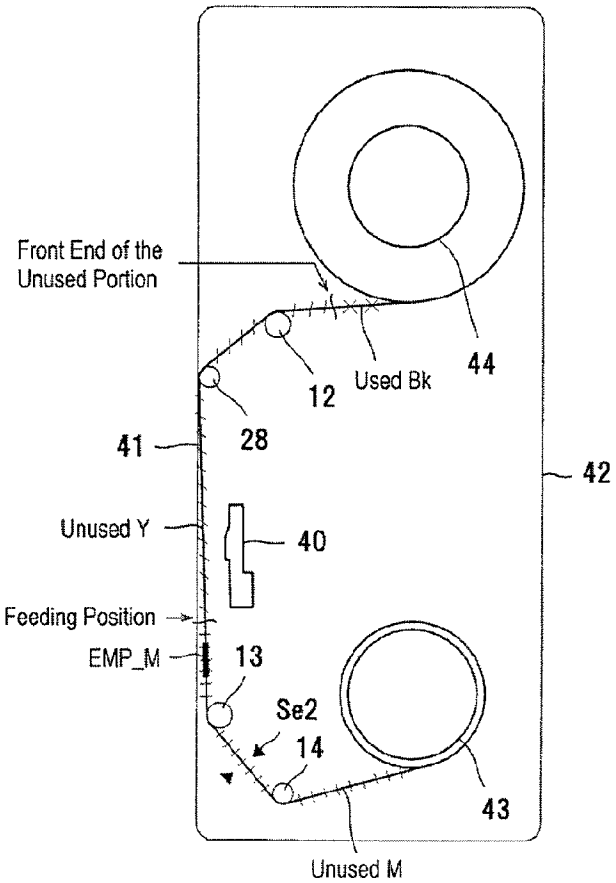
FIGS. 16A to 16B are explanatory views schematically showing the relationship between a sensor for detecting the ink ribbon and an empty mark, viewed from the arrow A side of FIG. 12, where
Figure 16A:
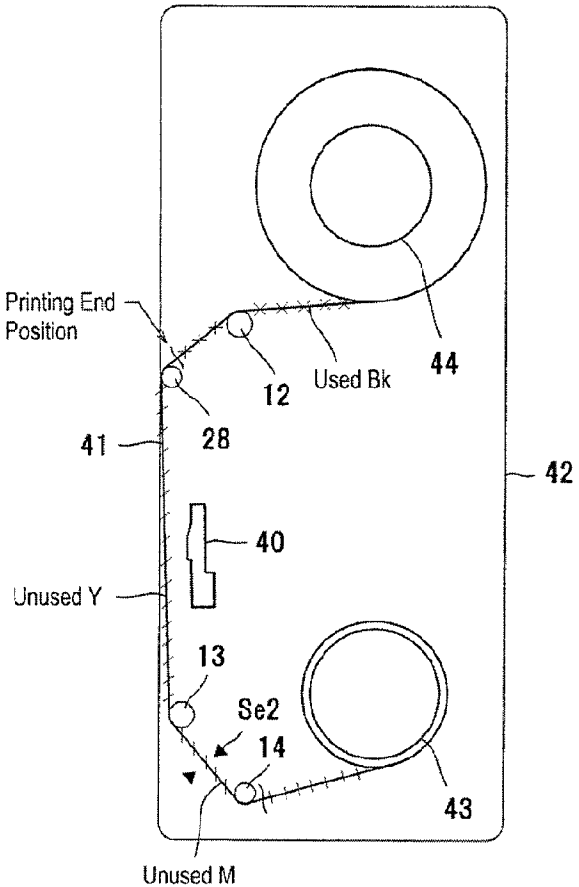

Meanwhile, in step S5 in FIG. 15, since the ink ribbon 41 is near empty that the remaining quantity is few, in order to detect the empty mark indicative of the use limit of the ink ribbon 41 (cassette 42) attached to the end portion of the ink ribbon 41, as shown in FIG. 16B, the CPU drives the motors Mr1 and Mr3 to rotate forward so as to wind the ink ribbon 41 around the wind-up spool 44 until the empty mark EMP_M arrives at a position detectable by the sensor Se2. By this means, the front end of the unused portion of the ink ribbon 41 runs over the printing end position shown in FIG. 16A, and is transported to the periphery of the wind-up spool 44. At this point, the CPU monitors an output of the sensor Se2, and determines whether or not the sensor Se2 detects the empty mark EMP_M (step S6 in FIG. 15).

In addition, the empty mark EMP_M is attached to the ribbon panel of the second color M (Magenta) among the ribbon panels of Y (Yellow), M (Magenta), C (Cyan) and Bk (Black). This reason is that the thermal head 40 and the platen roller 45 are in the nip state until the rear end of the used portion of the Bk (Black) panel passes through the peeling member 28, and that when the empty mark EMP_M is attached to the ribbon panel of Y (Yellow), there is a possibility that the empty mark EMP_M is peeled off while passing through between the thermal head 40 and the platen roller 45 in the nip state for a period during which the Bk panel is transported to the printing end position shown in FIG. 16A. Further, in the case of attaching to the ribbon panel of C (Cyan), transport in step S5 needs to be further performed and becomes a cause of developing skew and the like, and such a case is not preferable. Furthermore, the empty mark EMP_M is detected by the transmission sensor Se2, and therefore, it is not possible to attach the mark to the Bk (Black) panel (not possible to detect). Accordingly, to reduce transport in step S5 as much as possible, the empty mark EMP_M is attached near the front end of the ribbon panel of M (Magenta) that is the second color linearly so as to cross the width direction (main scanning direction) of the ribbon panel of M (Magenta).

In a negative determination in step S6, near empty processing is performed in next step S7. In other words, the CPU drives the motors Mr3 and Mr1 to rotate backward so as to rewind the ink ribbon 41 around the supply spool 43 until the front end of the unused portion of the ink ribbon 41 arrives at the printing end position or a predetermined position (feeding position of the next color) beyond the printing end position, and halts driving of the motors Mr1 and Mr3 to finish the ink ribbon transport processing.

In this example, the CPU drives the motors Mr1 and Mr3 to rotate backward so as to rewind the ink ribbon 41 around the supply spool 43 up to the beforehand set feeding position. (feeding position in FIG. 16B) positioned on the side closer to the supply spool 43 than the thermal head 40, and then, halts driving of the motors Mr1 and Mr3 to finish the ink ribbon transport processing. In addition, as described above, when the printing end position of the used portion of the ink ribbon 41 is the same as the feeding position of the unused portion of the ink ribbon 41, the ink ribbon 41 is rewound around the supply spool 43 until the front end of the unused portion of the ink ribbon 41 arrives at the printing end position shown in FIG. 16A.

As described above, in the case of this example, the position of the front end of the unused portion of the ink ribbon 41 is different between the time of normal processing and the time of near empty processing before starting printing of the next printing processing, and there is the case where supply of utility AC power supply to the printing processing 1 is interrupted before performing the next printing processing. Therefore, it is preferable that nonvolatile memory such as EEPROM is connected to the above-mentioned external bus. In such a case, for example, it is stored in the nonvolatile memory with a default value that above-mentioned step S5 finds near empty, and by referring to the nonvolatile memory in initial setting, even when power supply to the printing apparatus 1 is interrupted, it is possible to grasp the position of the front end of the unused portion of the ink ribbon 41.

Meanwhile, in a positive determination in step S6, the empty processing is performed in step S8. In other words, since the sensor Se2 detects the empty mark EMP_M, there is no usable ink ribbon 41, and the CPU halts driving of the motors Mr1 and Mr3 to finish the ink ribbon transport processing. Then, the CPU displays that replacement of the ink ribbon 41 (cassette 42) is needed in the operation panel section 5 via the operation control section 106, while informing the higher apparatus 201, and finishes the ink ribbon transport processing. An operator refers to the monitor 202 or refers to the operation panel 4, and is thereby capable of grasping that it is necessary to replace the ink ribbon 41 (cassette 42).

Accordingly, in this Embodiment, the CPU detects the rotation amount of the spool corresponding to the printing length in the sub-scanning direction of the printing data during driving of the thermal head 40 (step S1), instead of detecting the rotation amount of the spool during the passage of the Bk (Black) panel as in the convention techniques. Next, the CPU calculates the diameter of the spool from the detected rotation amount (step S2), compares a value of the calculated diameter with a value of the beforehand set diameter, and thereby determines whether or not the ink ribbon is near empty (step S3). When the CPU determines that the ink ribbon is not near empty, since the usable ink ribbon 41 is sufficiently left and it is not necessary to detect the empty mark EMP_M, the CPU controls so as to wind the ink ribbon around the wind-up spool 44 up to the printing end position in which the rear end of the used portion of the ink ribbon 41 passes through the peeling member (step S4, see FIG. 16A). Accordingly, it is not necessary to wind an excessive ink ribbon 41 around the wind-up spool 44 to detect the empty mark EMP_M, it is possible to suppress the transport amount of the ink ribbon 41 during printing operation, it is thereby possible to prevent skew of the ink ribbon 41 not to cause color deviation, and as a result it is possible to enhance the printing quality. Then, only in the case of determining that the ink ribbon is near empty, in order to detect the empty mark EMP_M, the CPU controls so as wind the ink ribbon 41 around the wind-up spool 44 until the empty mark EMP_M arrives at a position detectable by the sensor Se2 (step S5, see FIG. 16B), and then, when the empty mark EMP_M is not detected, controls so as to rewind the ink ribbon 41 around the supply spool 43 until the front end of the unused portion of the ink ribbon 41 arrives at the feeding position (step S7). When the empty mark EMP_M is detected, the CPU halts transport of the ink ribbon 41, and informs of the need of replacement (step S8).

In addition, this Embodiment shows the example in which the CPU detects rotation amounts of both the supply spool 43 and wind-up spool 44, and when the diameter of one of the spools exceeds a predetermined value, determines whether or not the ink ribbon is near empty, but the present invention is not limited thereto. The CPU may detect the rotation amount of one of the supply spool 43 and wind-up spool 44 to determine whether or not the ink ribbon is near empty when the diameter of the spool exceeds a predetermined value.

Further, this Embodiment shows the example of driving the motors Mr1 and Mr3 in the same direction, but the invention is not limited thereto. The ink ribbon 41 may be transported by driving one of the motors Mr1 and Mr3 to rotate forward, while driving the other one to rotate backward, or may be transported with one of the motors Mr1 and Mr3. In this case, the driving force of one of the motors Mr1 and Mr3 may be transferred to the supply spool 43 and wind-up spool 44 with a gear or the like.

Furthermore, this Embodiment shows the ink ribbon 41 configured by repeating ribbon panels of Y (Yellow), M (Magenta), C (Cyan) and Bk (Black) in a face sequential manner, and as already known in conventional techniques (see Patent Document 1, paragraph [0038]), the ink ribbon may have a protective layer and the like in addition to the panels. Still furthermore, this Embodiment shows the example in which the color ribbons are in the order of (Yellow), M (Magenta) and C (Cyan), and as long as the ribbon has at least above-mentioned three colors, the order may be changed as appropriate. The ribbon may have a ribbon panel of another color (silver or gold).

Moreover, in this Embodiment, after detecting near empty, the ribbon is wound until the front end of the unused portion of the ink ribbon 41 is positioned in front of the wind-up spool 44 as shown in FIG. 16B beyond the printing end position as shown in FIG. 16A. When an unused portion of the ink ribbon 41 is wound around the wind-up spool 44, the unused portion of the ink ribbon 41 is pressed against the wound used ink ribbon, and there is the risk that a wrinkle occurs in the unused portion of the ink ribbon 41. In this Embodiment, since the unused portion of the ink ribbon 41 is not wound around the wind-up spool 44 in ribbon transport after detecting near empty, any wrinkle does not occur in the unused portion of the ink ribbon 41, and there is also the effect of not degrading the image quality.

In addition, this application claims priority from Japanese Patent Application No. 2013-071838 incorporated herein by reference.

The invention claimed is:

1. A printing apparatus for performing printing processing on a recording medium with a thermal head via an ink ribbon, comprising:

a thermal head that heats a plurality of heater elements lined up in a main scanning direction selectively according to printing data;

an ink ribbon laid between a supply spool and a wind-up spool;

a transport device transporting the ink ribbon to be wound around the wind-up spool or to be rewound around the supply spool;

a sensor provided between the supply spool and the thermal head to detect an empty mark attached to an end portion of the ink ribbon to indicate a use limit of the ink ribbon;

a peeling member provided between the thermal head and the wind-up spool to peel off the ink ribbon and the recording medium;

a rotation amount detecting device detecting a rotation amount of at least one spool of the supply spool and the wind-up spool; and a control device controlling driving of the thermal head and transport of the ink ribbon by the transport device, wherein the control device calculates a diameter of the at least one spool from the rotation amount of the at least one spool detected in the rotation amount detecting device corresponding to a printing length in a sub-scanning direction of the printing data during driving of the thermal head, compares a value of the calculated diameter with a value of a beforehand set diameter, thereby determines whether or not the ink ribbon is near empty indicative of running short, and when determining that the ink ribbon is not the near empty, controls the transport device to wind the ink ribbon around the wind-up spool up to a printing end position in which a rear end of a used portion of the ink ribbon passes through the peeling member, while when determining that the ink ribbon is the near empty, controlling the transport device to wind the ink ribbon around the wind-up spool until the empty mark arrives at a position detectable by the sensor, and then controlling the transport device to rewind the ink ribbon around the supply spool until a front end of an unused portion of the ink ribbon arrives at the printing end position or at a predetermined position beyond the printing end position.

2. The printing apparatus according to claim 1, wherein in a case of determining that the ink ribbon is the near empty, the control device controls the transport device to wind the ink ribbon around the wind-up spool until the empty mark arrives at a position detectable by the sensor, determines whether or not the sensor detects the empty mark, and when determining that the empty mark is not detected, controls the transport device to rewind the ink ribbon around the supply spool until a front end of an unused portion of the ink ribbon reaches a beforehand set feeding position positioned on the side closer to the supply spool than the thermal head, while when determining that the empty mark is detected, controlling the transport device to halt transport of the ink ribbon.

3. The printing apparatus according to claim 2, further comprising:

a notifying device notifying that replacement of the ink ribbon is needed, wherein in a case of determining that the ink ribbon is the near empty, when determining that the empty mark is detected, the control device notifies the notifying device that replacement of the ink ribbon is needed.

4. The printing apparatus according to claim 1, wherein a plurality of color ribbon panels is disposed between a ribbon panel of Bk (Black) and a next ribbon panel of Bk (Black), the ink ribbon is configured by repeating the color ribbon panels and the ribbon panel of Bk (Black) in a face sequential manner, and the empty mark is attached to a ribbon panel of a second color among the color ribbon panels.

5. The printing apparatus according to claim 4, wherein the color ribbon panels include at least three colors of Y (Yellow), M (Magenta) and C (Cyan), and a length of the ink ribbon laid between the supply spool and the wind-up spool is shorter than a total length of three ribbon panels among ribbon panels of successive four colors of Y (Yellow), M (Magenta), C (Cyan) and Bk (Black).

6. The printing apparatus according to claim 4, wherein along the ink ribbon laid between the supply spool and the wind-up spool, each of a distance between the supply spool and the sensor, a distance between the sensor and the thermal head, a distance between the thermal head and the peeling member, and a distance between the peeling member and the wind-up spool is shorter than a length of a ribbon panel of one color of the ink ribbon.

* * * * *